United States Patent [19]

Olsen

[11] 4,087,072

[45] May 2, 1978

[54] FORM MEANS FOR FABRICATING PRE-CAST STRUCTURAL PANELS

[76] Inventor: Audun P. Olsen, 13 Aldrich Ct., Bay Shore, N.Y. 11706

[21] Appl. No.: 770,940

[22] Filed: Feb. 22, 1977

[51] Int. Cl.[2] ..... B28B 7/24; B28B 7/2; B28B 7/20

[52] U.S. Cl. ..... 249/129; 249/99; 249/160; 249/164; 249/219 R; 249/155; 249/154

[58] Field of Search ..... 249/2, 8, 9, 119, 129, 249/131, 160, 155, 163, 164, 165, 189, 219 R, 99; 425/4 R

[56] References Cited

U.S. PATENT DOCUMENTS

| | | | |
|---|---|---|---|
| 1,199,877 | 10/1916 | Cutler | 249/129 |
| 2,274,236 | 2/1942 | Hopkins | 249/165 X |
| 2,610,381 | 9/1952 | Rosati et al. | 249/2 |
| 2,831,232 | 4/1958 | Lawson | 249/129 X |
| 3,110,949 | 11/1963 | Tullio et al. | 249/155 X |
| 3,281,110 | 10/1966 | Lister | 249/155 X |

FOREIGN PATENT DOCUMENTS

| | | | |
|---|---|---|---|
| 246,005 | 3/1966 | Austria | 249/129 |
| 1,095,185 | 10/1960 | Germany | 249/129 |

*Primary Examiner*—J. Howard Flint, Jr.
*Attorney, Agent, or Firm*—Morgan, Finnegan, Pine, Foley & Lee

[57] ABSTRACT

A method and associated form assembly for forming pre-cast structural panels includes the steps of and associated apparatus for constructing an open-top disassemblable form box, reinforcing the form box with a collar assembly affixed around the form box for rigidly maintaining the shape thereof, with divider assemblies in the form box to provide a plurality of form compartments adapted to form structural panels disposed on-edge on the form box bottom panels and with insulation panels supported in the form compartments, pouring a hard-setting material into the form compartments, allowing the material to harden into structural panels, and at least partially disassembling the form box to expose a panel for removal. As preferably embodied, end wall separator panels support both the insulation panels in desired positions within the form compartments as well as the divider assemblies, and are releasably attached to and supported by an end wall assembly frame, with bottom separator panels at the bottom of the form box in correspondence with the end separator panels. A method of wall construction further includes the steps of placing a steel cable around the edges of all the concrete layers of the hardened panel, standing the panel up-right, lifting the panel to the desired position on the structure under construction, positioning the panel between reinforcing rods embedded in the structure, removing the cable, and filling the inter-panel spacings, with reinforcing rod encased therein, with mortar.

30 Claims, 34 Drawing Figures

FORM MEANS FOR FABRICATING PRE-CAST STRUCTURAL PANELS

BACKGROUND AND OBJECTS OF THE INVENTION

The present invention relates generally to apparatus for use in constructing permanent structures, such as homes, buildings and the like, and more particularly, to a new and improved form means for forming pre-cast structural members.

In general, the exterior walls of permanent structures intended for providing shelter, such as houses, and apartment or office buildings should satisfy several criteria. They must be structurally sound and provide thermal insulation for the occupants. They should also be resistant to fire, water damage, termites, etc., and should be durable and easily maintainable. In addition, the methods for constructing such exterior walls should be inexpensive in both labor and materials required, and should enable flexibility in design for an attractive and appealing exterior facade. Moreover, the materials utilized should cause little or no ecological waste or destruction.

In general, however, current construction techniques fail to satisfy at least ome of these criteria, while no such technique has heretofore satisfied all such criteria. As presently practiced, the most common construction methods involve one of the following approaches: wood frame exterior walls, concrete block or cinder-block walls, poured-in-place concrete walls and "tilt-up" pre-cast concrete walls.

The least expensive method of wall construction is the wood frame exterior wall method which is widely used in residential construction. However, it does not provide a very strong facade, as is particularly evident when the exterior and interior sheathing have not been attached to the frame, Moreover, wood frame construction is particularly notorious for its susceptibility to fire, termites, warping, water damage and rot, and the use of wood in construction has caused extensive depletion of our natural forests. Furthermore, unless the spacings between the wood studs are completely filled with thermal insulation, wood frame exterior walls provide poor insulation from heat and cold.

As an alternative to wood frame structures, concrete block construction offers some improvements, particularly its strength, but suffers two principal disadvantages. First, concrete block construction is significantly more expensive than wood frame construction. The higher costs arise from the materials themselves, as well as from the labor required in handling the blocks, e.g., the transporting and hand setting of the blocks, etc.

Secondly, concrete blocks provide very poor thermal insulation. For example, since common concrete blocks include a concrete "webbing" between the inner and outer surfaces of the block, relatively short thermally conductive paths exist between the two surfaces, which make the blocks poor thermal insulators. Therefore, a solid sheet of right insulation must be bonded to any wall formed of the blocks in order to provide adequate thermal insulation. This involves additional labor and material costs and, since the commonly used insulation (polystyrene or urethane foam) is flammable and produces toxic fumes upon combustion, it also involves a fire hazard as well. This hazard can, of course, be mitigated by bonding the insulation between two walls of concrete blocks, but such double-walled construction involves totally intolerable cost levels.

Similarly, wall sections made from product-in-place concrete are also expensive, since extensive forms must be set in place and the concrete pumped upwardly against gravity or otherwise delivered to the "pour" site. Furthermore, the inner and outer forms are usually held together by metal ties, or "snap ties", which leave surface imperfections on the concrete, that must be hand-smoothed after the forms are removed. In addition, after the forms are disassembled, they can only be reused if first treated with an oil-like substance to prevent concrete from sticking. Thus, forms are often destroyed after use, thereby ultimately adding to the waste of natural wood resources.

It can be readily appreciated, therefore, that the costs of materials and labor involved in erecting the forms are significantly greater than those of wood frame construction. In addition, the thermal insulation provided by concrete walls is about as poor as that of the concrete block and usually requires bonding a sheet of insulating material to the wall, with the same drawbacks, however, as discussed with respect to concrete block construction.

One alternative to concrete block and poured concrete wall construction has been the use of pre-fabricated concrete panels, produced at a place distant from the construction site (i.e., off-site). Aside from the costs of materials used to make the panels as well as the time-consuming fabrication techniques (including a repetition of the levelling operation), additional costs arise because the panels are made off-site by a company independent of the construction contractor so that not only must the company's reasonable profits be paid but also the costs for transporting the panels to the construction site.

Moreover, structural steel is often embedded in the concrete to provide internal reinforcing for the weight of the concrete panel to prevent damage as it is erected from its form mold, transported to the construction site and as it is lifted into place in the building. However, after the panel is installed as a wall section, much of the steel reinforcing is superfluous due to the inherent compressive strength of concrete. In addition, the joining methods commonly used in securing the panels to each other and to the foundation require additional operations to prevent any structural weaknesses. Such panel fabrication suffers the same thermal insulation drawbacks as the poured concrete or concrete block methods of construction.

Recently, however multi-layer pre-fabricated concrete panels have been made, such as disclosed in U.S. Pat. Nos. 3,295,278 and 3,220,151, which include a heat insulating layer sandwiched between two layers of concrete. Such panels provide good overall thermal insulation but usually include steel reinforcing rods or concrete dowels between the inner and outer layers, causing short thermal paths between layers, which generate "cold spots" in the panels. In addition, no method of fabrication has heretofore been developed to lessen the costs still associated with forming pre-fabricated concrete panels. Moreover, no method of fabrication has been developed for enabling convenient and inexpensive on-site fabrication of multi-layer structural panels.

It is therefore an object of the present invention to provide a new and improved form means for construction. Another object of the present invention is to provide a new and improved form means for use in construction, to provide strong and thermally insulative walls, at relatively low costs.

It is another object of the present invention to provide a new and improved form means for forming pre-cast structural panels directly at the construction site.

It is a further object of the present invention to provide a new and improved apparatus for making pre-cast structural panels which can be installed in place without requiring much reinforcing structural steel heretofore used in such panels.

It is another object of the present invention to provide a new and improved form means for forming pre-cast structural panels, which can obviate the need for pre-stressing the reinforcing structural steel in such panels as heretofore done.

It is also an object of the present invention to provide a new and improved form means for making pre-cast structural panels, which substantially eliminates the waste of plywood or other form structures.

It is an additional object of the present invention to provide a new and improved mold form, which is inexpensive and essentially completely re-usable.

It is also another object of the present invention to provide a new and improved form means for forming pre-cast structural panels, which substantially eliminates the need for hand finishing the surfaces of the panels.

It is still a further object of the present invention to provide a new and improved apparatus for making pre-cast concrete panels for use in wall construction, which enables substantial thermal insulation to be provided in the panels without requiring double-walled construction or otherwise significantly raising construction costs.

It is also a further object of the present invention to provide a new and improved form means for forming pre-cast structural panels which enables substantial flexibility in panel design, size and characteristics by the same basic form means.

It is also an additional object of the present invention to provide a new and improved form means, which eliminate the need for multiple form erection and disassembly and allows concrete to be poured directly from a transit truck or a mixer.

It is still another object of the present invention to provide a new and improved form means, which enables the inexpensive fabrication of curved wall sections by essentially the same basic form means.

Objects and advantages of the invention are set forth in part herein and in part will be appreciated herefrom, or may be learned by practice with the invention, the same being realized and attained by the apparatus set forth in the appended claims. Accordingly, the present invention resides in the novel structures and apparatus disclosed and claimed herein.

SUMMARY OF THE INVENTION

Briefly described, the form means for forming pre-cast structural panels according to the present invention includes the an open-top disassemblable form box which is surrounded with reinforcing means for rigidly maintaining the shape of said form box in which divider means are positioned to provide a plurality of form compartments for forming a plurality of structural panels, each disposed on one edge, and in which panels of thermal insulation can be supported in appropriate positions according to the desired configuration in the resultant panel. Advantageously, the form box includes a pair of generally opposed end wall assemblies, each comprising an end wall frame and a plurality of end separator panels adapted to be releasably supported on the frame and arranged in sets corresponding to the desired configuration for the resultant hardened panel, with layers of thermal insulation supported by the end separator panels to provide such desired configuration. In addition, bottom separator panels, dimensioned to correspond to the arrangement of the end separator panels, are positioned in sets at the bottom of the form box and divider assemblies are placed against each set of corresponding end and bottom separator panels to isolate one set from another and provide separate form compartments. As preferably embodied, the reinforcing means comprise collar means tightened around the form box to hold all the components which are located interiorly of the form box fixedly in position for receiving the concrete. Also as preferably embodied, the collar means are adjustable to accommodate, for example, form compartments of various thicknesses and/or numbers.

As preferably embodied, the present invention includes apparatus for providing key-ways in at least the side edges of the resultant pre-cast structural panels by positioning appropriately shaped key forms on the bottom separator panels and presing such key forms into the top surface of the wet concrete. Thus, a generally flexible cable may be inserted around the hardened panel through the keys for standing the panel upright on-edge and lifting it into position on the structure, wherein structural reinforcing members have been positioned for generally abutting the side edges of the pre-cast panels, positioning the structural panels on the structure with such reinforcing elements generally contained between and within the keys of adjacent panels, and filling in the keys with mortar. In addition, the concrete panels may be adapted to form the foundation or "crawl space" for the structure to be constructed.

It will be found that by the form means for making pre-cast structural panels according to the present invention, structurally strong pre-cast concrete panels can be made easily and inexpensively, directly at the construction site for overall low cost construction, with essentially no waste of materials. Thus, the present invention enables the form members to be reused almost indefinitely or to be incorporated into the structure being built when panel-forming is complete. Moreover, squared corners on the resultant panels are ensured due to the tightened collar means and the squared divider, separator and end wall assemblies.

It will also be found that by including divider means in the hollow form box, the panel constituents can be placed into the several compartments to provide, after hardening, a "loaf" of pre-cast structural panels lying on edge, which can be simply transferred from the form means to any desired location in the building under construction. Thus, the amount of internal reinforcing will be minimized and the need for pre-stressing is substantially obviated. Moreover, by providing end wall assemblies with releasable end separator panels, any desired laminate configuration can be achieved in the pre-cast concrete panel, including one or more layers or sections of thermal insulation extending length-wise therein for a thermally insulated solid wall panel without any exposed flammable material and without requiring a doubly constructed wall. Furthermore, the form means can be assembled with standard shaped divider panels and insulation panels, such as 4 × 8 foot panels, in a relatively small area for convenient use and easy access by, for example, concrete trucks, etc.

Also, advantageously, the present invention enables fabrication of pre-cast panels which include concrete layers having corrugated interior-facing surfaces for greater buckling strength, thereby obviating the need for reinforcing steel. To the contrary currently known tilt-up techniques would form voids if such corrugated interior surfaces were attempted to be formed. Moreover, unlike current tilt-up fabrication techniques, at most only one levelling operation is required for each complete "pour" of concrete according to the present invention since the panels are "poured" on-edge. In addition, the form means for forming concrete panels according to the invention enables virtually unlimited design potential for both exterior surface configurations (as determined by the particular separator panel assemblies and divider assemblies) as well as the interior laminate configurations (as determined by the separator panel assemblies and the insulative layers).

Moreover, if steel reinforcing rods are needed in the concrete panels, suitable holes may be formed in the end separators to support such rods extending from end to end. Alternatively, the steel reinforcing can be embedded in one or more layers of insulation. In addition, still bolts, if desired can also be inserted through holes formed in the end separator panels.

Pre-cast concrete panels made by the apparatus according to the present invention, may be formed with a key along each side edge to enable convenient means for lifting the panel to its position in the building. Moreover, by providing reinforcing rods extending from the foundation to be surrounded by the keys of adjacent pre-cast panels, with mortar poured in the inter-panel spacing, not only are adjacent panels securely fastened to each other, but also the panels are securely affixed to the foundation or the structure itself, all without welding.

It will be understood that the foregoing general description as well as the following detailed description are exemplary and explanatory of the invention, but are not restrictive thereof. To this end, the accompanying drawings, referred to herein and constituting a part hereof, illustrate preferred embodiments for carrying out the invention and, together with the detailed description, serve to explain the principles thereof. In this context, it will be understood that various dimensions described herein are merely exemplary and that, in practicing the invention, dimensions for the various layers will be computed in accordance with conventional design techniques and considerations.

DETAILED DESCRIPTION OF PREFERRED EMBODIMENTS

Figure 1:
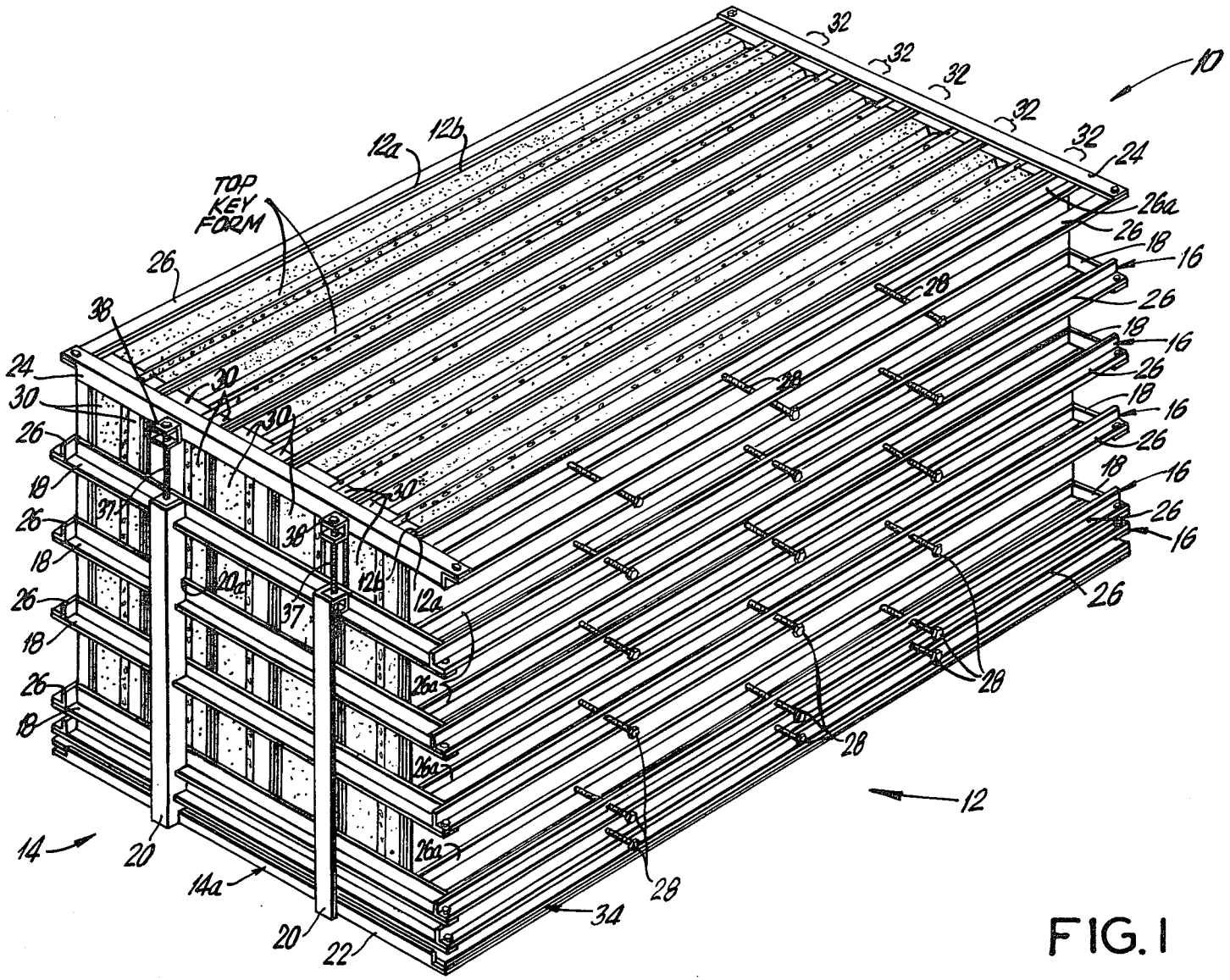
FIG. 1 is a perspective view of a preferred embodiment of form means according to the present invention.
Figure 2:
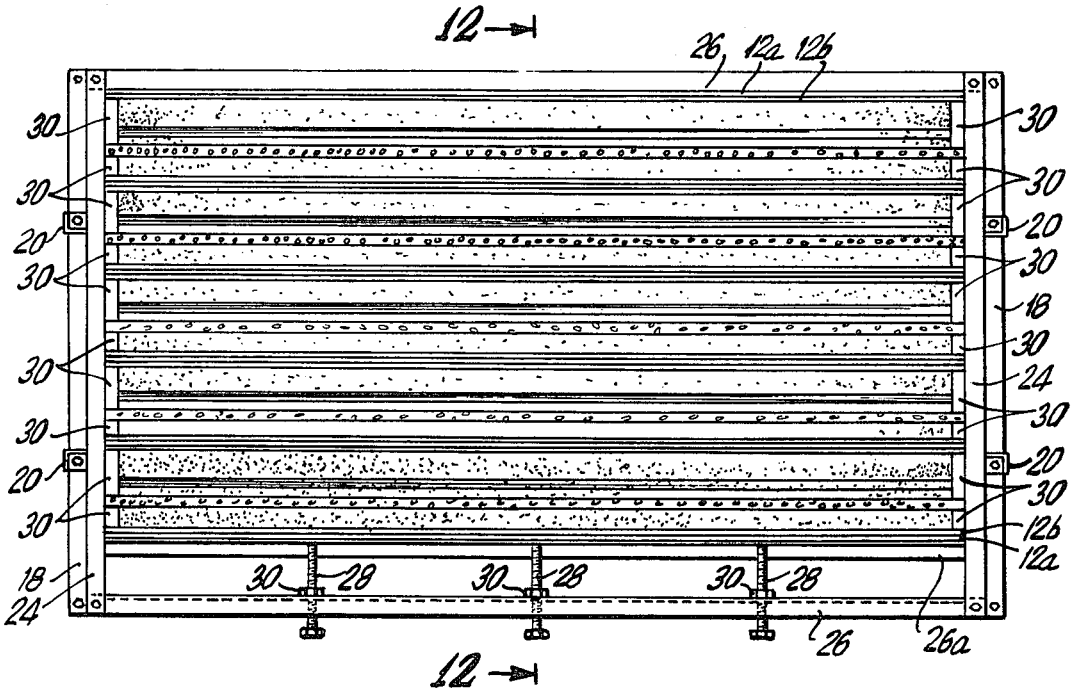
FIG. 2 is a top view of the embodiment shown in FIG. 1.

Referring now generally to the embodiments of the invention illustrated in the accompanying drawings, there is shown in FIGS. 1–2, a preferred embodiment of form means (indicated generally by reference number 10) according to the present invention, adapted for making on-site pre-cast structural panels.

Referring more particularly to FIGS. 1 and 2, form means 10 comprise two opposed side wall assemblies, each indicated by reference numeral 12, and two opposed and preferably identical end wall assemblies, each indicated by reference numeral 14 (although only one is visible in FIG. 1), adapted for assembly into a box-like form means having a generally hollow space interior thereof, except for the inclusion of elements hereinafter described. In addition, releasable fastening means, in the form of a plurality of reinforcing collars 16, surround form means 10 for supporting the end and side walls in upstanding positions, as hereinafter described, and fixedly maintaining the hollow space defined therein. Thus, despite the internal pressure of the wet concrete when poured into and retained within form means 10, the wall members will be supported to ensure that the resultant pre-cast panels are identical in length and width and free from dimensional deviations beyond allowable tolerances. As preferably embodied, the end wall portions of the collars 16 may be incorporated as part of end wall assemblies 14, as more fully described hereinafter.

Figure 4A:
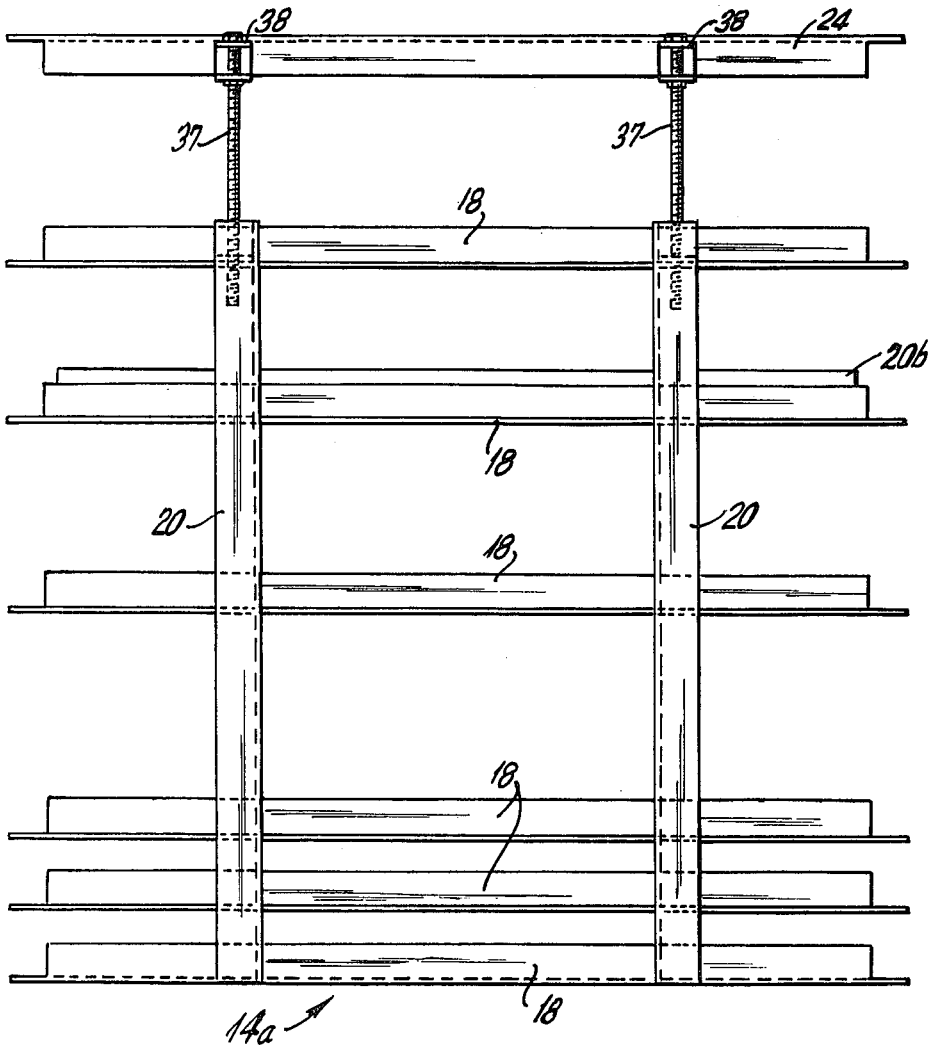
FIG. 4*a* is an elevation view of the end wall assembly frame according to the embodiment of FIG. 1.

End wall assemblies 14 advantageously include end wall frame 14*a* (shown more particularly in FIGS. 4*a* and 4*b*) adapted to releasably support a plurality of end separator panels (discussed more fully herein with respect to, e.g., FIGS. 5–9) which are adapted to be in contact with the poured concrete (of course, although the present invention is described for use with concrete, it will be understood that other suitable hard-setting materials may be used). As preferably embodied, frame 14*a* includes lateral (or horizontally extending) support members 18 which, advantageously, form the end wall segments of reinforcing collars 16 and which are supported together by longitudinal (or vertically extending) support members 20. Thus, both ends of each lateral support member 18 is adapted for releasable attachment to the other members making up the remainder of each collar 16, as more fully described hereinafter.

Figure 4B:
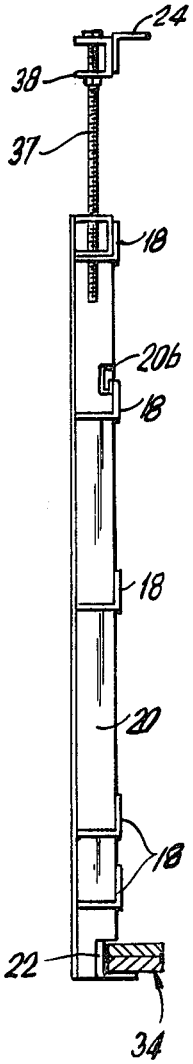
FIG. 4*b* is a side view taken along lines 4*b*—4*b* of FIG. 4*a*.

As shown in FIG. 4*b*, lateral members 18 are adapted to provide a continuous plane on their interior surfaces for providing flush support against all the end separator panels. Thus, frame 14*a* also includes means for releasably supporting the end separator panels in accordance with the invention. To this end, for example, longitudinal support members 20 may be formed with slots 20*a* for retaining channel member 20*b* (shown in FIG. 4*b*) adapted to accommodate slidable attachment of fastening members which are attached to the back surfaces of the separator panels and shaped for insertion into the channel member 20*b*. Alternatively, member 20*b* may simply be an elongate support bar and hook or clamp-like means (indicated as reference numeral 29 in FIGS. 5*a*–9*a*) may be attached to the back surfaces of the end separator panels for hooking onto bar 20*b*.

Frame 14*a* also advantageously includes bottom support member 22 for engaging the bottom support panel (indicated at 34 in FIGS. 4*b* and 12) upon which the bottom separator panels (discussed more fully hereinafter) lie. In addition, frame 14*a* may include adjustable top buoyancy hold 24 for securely retaining the end separator panels, the divider assemblies and the sheets of insulation in position and preventing displacement of these elements, particularly for the divider assemblies and the insulation when the concrete is poured, since they may have a tendency to rise due to their buoyancy in concrete.

Figure 12:
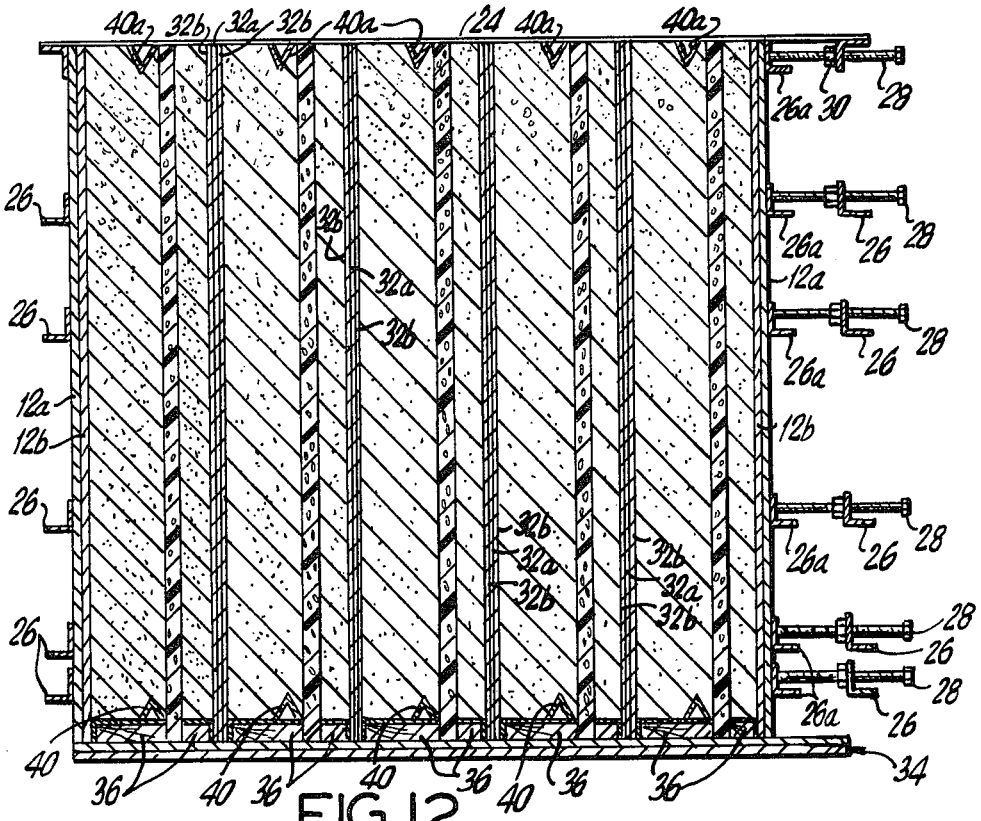
FIG. 12 is a sectional view taken along lines 12—12 of FIG. 2.

Referring more particularly to FIGS. 2 and 12, each side wall assembly 12 includes a generally flat exterior side wall member 12*a* which is adapted for providing generally substantial structural rigidity for withstanding the internal pressures generated by the concrete when reinforced by collars 16, so that there is little or no deflection of wall member 12*a*. Advantageously, for low cost and convenience, side wall member 12*a* may be one or more pieces of plywood of standard size (i.e., about 4 × 8 feet) providing a total thickness of about ½ to about 1 inch. As preferably embodied, side wall assembly 12 includes insert panel 12*b* which is adapted to prevent concrete from sticking to its surface and has a length and width identical to member 12*a*. Accordingly, side wall assembly 12 is completely re-usable for substantial economic savings. Moreover, since the plywood sheet(s) 12*a* need not be oiled to prevent sticking, they may be used for roofing after all the concrete panels have been made, thereby maximizing the use of materials.

In order that side wall assemblies 12 are supported so as to withstand the internal pressure generated by the fluid-state concrete contained within form means 10, side reinforcing struts 26 are coupled to the ends of lateral support members 18 of the two end frames 14*a*. Each collar 16 thereby comprises two lateral support members 18 coupled to and between two side struts 26. Advantageously, side struts 26 are adapted to be tightened onto members 18 such that they firmly bear against their corresponding side wall assembly 12 prior to pouring concrete into form means 10.

Advantageously, all of lateral members 18 and side struts 26 are L-shaped angle irons. Thus, the vertical leg portions of members 18 are adapted to abut the end separator panels and distribute the rigid support provided by the horizontal leg over a large area (i.e., the surface area of the interior facing surface of the vertical legs). Similarly, the vertical leg portions of side struts 26 abut side wall assemblies 12 to transmit the rigidity provided by the horizontal leg portions to the exterior surfaces of side wall assemblies 12 and prevent assemblies 12 from bulging under the fluid pressure of the wet concrete.

Figure 21:
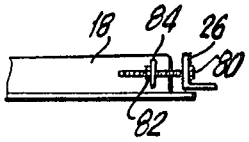
FIG. 21 is a side view of an alternate collar fastener according to the invention.

If form means 10 is adapted to utilize the same interior components (i.e., separator panels and divider assemblies described more fully hereinafter) to fabricate pre-cast panels of identical thicknesses, collars 16 may be of almost fixed dimensions, with small adjustment means for tightening all the form elements together. Thus, for example, the coupling means between members 18 and struts 26 may simply comprise holes formed in the end of each member 18 and strut 26, which are aligned when one of member 18 or strut 26 overlies the other and through which a pin or bolt is inserted, as readily apparent from FIG. 3. However, in order to facilitate tightening collars 16, one corner (or both corners on the same side of form means 10) may be provided with a bolt-and-nut arrangement as shown in FIG. 21 so that the back of the vertical leg of strut 26 can be brought into abutting relationship with the edge of the vertical leg of member 18 by threading bolt 80 onto nut 82 bearing against flange 84 formed on member 18.

However, as preferably embodied, and in order to provide form means 10 with the capability for fabricating panels of various dimensions as well as to allow variability in the number of panels which can be fabricated, collar assembly 16 is adapted to allow large adjustment to the distance between oppositely disposed side wall assemblies 12. According to this aspect of the present invention, (as shown more particularly in FIGS. 1 and 12) side struts 26 are simply attached to the ends of lateral members 18, such as by inserting a bolt or pin through holes formed in corresponding overlying horizontal legs of members 18 and struts 26, substantially as described above and as illustrated in FIGS. 1 and 2. In addition, the vertical leg portions of all the side struts 26 on at least one side of form means 10 are formed with spaced apertures (not numbered) through which threaded bolts 28 extend. Accordingly, bolts 28 are adapted to bear against struts 26 and a side wall assembly so that the support of struts 26 can be transmitted to the side wall assembly 12 by bolts 28. Thus, bolts 28 can either be threadably received in threaded boreholes formed in the vertical legs of adjustable side struts 26, or, as preferably embodied, they may extend through unthreaded holes, while threaded onto large nuts 30 on the inside of the vertical leg of the struts 26. Accordingly, extensible support means are provided whereby the distance between the "support plane" defined by the free ends of bolts 28 and the plane defined by the vertical legs of struts 26 on that side of form means 10 may be adjustable.

As preferably embodied, the free ends of bolts 28 (which abut side wall assembly 12*a*) are adapted to prevent penetrating or puncturing side wall assembly 12 as well as to distribute the supporting force of bolts 28 onto side wall 12*a*. To this end, additional struts 26*a* may be positioned against (or attached to) the exterior surface of side wall 12*a* and positioned to correspond to the relative locations of adjustable struts 26. Thus, bolts 28 can be threaded so that nuts 30 bear against the vertical leg of adjustable side struts 26 while their free ends abut additional struts 26*a* to squeeze the pairs of side walls together. In this way, the supportive force generated by bolts 28 may be transmitted generally evenly throughout side wall assembly 12 on that side of form means 10.

Also as preferably embodied, reinforcing collars 16 are arranged vertically about form means 10 such that they are more closely spaced together near the bottom of form means 10 than at the top, to accommodate the greater pressure generated at the wet concrete at the bottom and to insure the side wall assemblies do not bulge to distort the surfaces of the resultant panels.

As indicated above, end separator panels, indicated by reference numeral 30 in FIGS. 5–9, are attached to end wall assembly frame 14*a*. The end separator panels serve not only to provide the form for the top and bottom edges of the resultant pre-cast structural panel but also to retain layers or panels of, for example, thermal insulation in desired locations thereby to define the internal configuration of the resultant concrete panel — i.e., its laminate configuration or characteristics. Accordingly, each set of end separator panels 30 are adapted to support the thermal insulation panels in appropriate position to define the desired internal laminated characteristic of the hardened concrete panel. Thus, the solid portion of each end separator panel 30 in a set (bracketed in FIGS. 1 and 2) will correspond to solid concrete in the hardened concrete panel, while spacing between or among (if more than two separator panels are used in a set) adjacent end separator panels will correspond to layers or sections of thermal insulation.

As indicated above, each end separator panel 30 is adapted for being releasably, and preferably slidably, attached to end assembly frame 14*a*. To this end, attachment means are affixed to the back of each end separator panel 30. The attachment means may be in the form of hooks 29 adapted simply to be latched onto support bar 20*b* on frame 14. Alternatively, support bar 20*b* may be formed with a channel and hook 29 may be formed to correspond to the channel and be slidably inserted thereinto.

In addition, each set 30 of end separator panel serves to support the divider panel assemblies (indicated at 32) which divide the hollow form box into form compartments. Thus, as shown in FIG. 1, form means 10 includes four divider assemblies 32, which provide five form compartments, thereby requiring five sets of end separator panel assemblies. Advantageously, and for low-cost, divider assemblies 32 are made up of three panels, a central panel 32*a* adapted for structural rigidity (such as a standard sheet of ½ or ¾inch plywood similar to side wall member 12*a* ) sandwiched between two thin inserts 32*b* (similar side wall members 12*b*) adapted to provide non-sticking surfaces adjacent the concrete. Thus, it will be understood that inserts 12*b* and 32*b* may be formed with an appropriate surface design to provide the desired texture on the outer surfaces of the hardened panel.

As indicated above, a bottom panel, indicated at 34, (which may be a double layer of plywood sheets) is positioned within the retaining space of angle irons 22 of end wall frames 14*a*, so that the bottom edges of end separator panels 30 abut the top surface of bottom panel 34. In addition, sets of bottom separator panels 36 are placed on top of bottom panel 34 and are provided with a configuration corresponding to end separator panel assemblies. That is, the solid portions of each bottom separator panel 36 corresponds to solid concrete in the resultant hardened concrete panel, while spacing between, or among, adjacent bottom separator panels corresponds to layers or sections of thermal insulation. In addition, at least one bottom separator panel 36 in each set thereof (each set corresponding to a resultant concrete panel) is provided with key structure, or form, 40 for forming a key-way in a concrete layer of the resultant hardened panel, the purpose for which will become more evident hereinafter.

As preferably embodied, end separator panels 30 and bottom separator panels 36 may be made of the same material(s). Thus, for example, the panels may be made of strips of generally hard wood (to withstand the compression forces for assembling form means 10, as hereinafter described) and coated on their surfaces to be adjacent the concrete, so as not to allow adherence by concrete. This may be accomplished, for example, by overlying a thin (1/64 to 1/16inch) sheets of metal (attached by bonding or nailing to surfaces not exposed to concrete) over the wood substrate or by applying or coatings of non-stick compounds such as "TEFLON". Alternatively, the separator panels may be made of stainless steel or any other compressibly strong material adapted to prevent adherence by concrete. However, from the standpoint of cost and ease of fabrication, the wood with metal coating is preferred. In addition, key forms 40 on bottom separators 36 may be attached to the wood block and then covered with the metallic coating or simply releasably attached to the metallic-coated block, such as, for example, wedging it into a longitudinal groove in the block.

The end separator panels are generally 4 feet long and about 1½ to about 2 inches thick so that, when using end walls 12*a* and divider walls 32*b* of standard 4 × 8 feet panels, the resultant panel will be within nominal building dimensions when hardened and installed. Analogously, the bottom separator panels will generally be slightly less then 8 feet long if they lie on bottom 34 and about ½ to about 2 inches thick. The key forms 40 will be at least about 2 inches tall and at least about 2 inches wide at their point of attachment to bottom panels 36, and may be, for example, triangular or trapezoidal in cross-section. However, it will be understood that, although using standard 4 × 8 feet components allows the use of readily available materials (e.g. common plywood panels), the present invention is adaptable so as to enable fabrication of panels of various widths (by the length of the selected end separator panel) and/or various lengths (by the lengths of the bottom separator panels 36, side support struts 26, side wall assemblies 12, divider assemblies 32, etc.).

In operation, form means 10 is assembled by attaching one set of side struts 26 (i.e. those which will be located adjacent the same side wall assembly 12) to the ends of members 18 on both frames 14*a* to form a U-shaped support frame. One or more of the other side side struts 26 may be attached to the other ends of members 18 after bottom 34 has been placed in the recesses formed by bottom hold 22 of frame 14*a*, in order to maintain the relative positions of all the elements during assembly. One side wall assembly 12 (the upper one in FIG. 2) is placed in abutting relation against the vertical legs of the first set of side struts 26. A pair of "mirror-image" end separator panels 30 may be attached, one on each end, to end frames 14*a*, and a corresponding bottom separator panel 36 placed on floor 34, followed by a panel (or strips) of thermal insulation, next to which is placed (i.e., by attaching to each frame 14*a*) another pair of end separator panels 30 and a corresponding bottom panel 36 placed on bottom 34, so that each end of the thermal layers is sandwiched between one each of the first two pairs of panels 30 and a side edge sandwiched between the two bottom panels. This may be accomplished in series, generally simultaneously on each end i.e., a first end separator panel and corresponding bottom separator panel, insulation, the next corresponding separator panels, etc.). After the first set of end separator panels and insulation layers is positioned, a divider assembly 32 is positioned against the first set of end and bottom separator panels. This sequence may be repeated until the desired number of form compartments have been generated.

Once all the sets of end and bottom separator panels (with insulation supported thereby) and divider assemblies have been located in appropriate position relative to each other, the other side wall 12*a* is positioned against the last set separator panels. Thereafter, the remaining side strut members 26 of the collar assembly are secured to the free ends of the lateral members 18 on both end frames 14*a* and then tightened against the second side wall assembly 12 (as by threading bolts 28 so as to abut additional struts 26*a*) to form a secure reinforcement around the form box. As a result, all the separator and divider assemblies will be urged against each other by the compressible forces generated by collars 16 and transmitted through the end wall assemblies and successive divider and separator panel assemblies, leaving a generally hollow form box, with various sized strips or sheets of insulation extending from one end of form means 10 to the other along with divider assemblies 32. Thereafter, the concrete may simply be poured into the empty spaces (with small vibrators used to ensure complete dispersion of the wet concrete) to form pre-cast structural panels having thermal insulation contained therein in desired configurations, and key forms 40*a* (similar to key forms 40 on the bottom separator panels) may be pressed into the top surface of the wet concrete to form a symmetrical set of key-ways on both sides of the resultant concrete panel.

Figure 22:
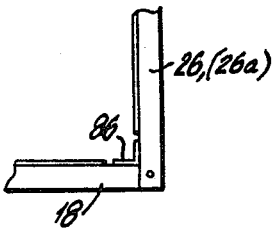
FIG. 22 is a plan view of optional corner brace according to the present invention.

It will be understood that the bottom separator panels 36 will be held down both as a result of the compressive forces generated by the tension in collars 16 as well as the weight of the concrete itself. In addition, additional L-shaped angle irons 86 may be inserted at the four corners of form means 10, each having one leg abutting the outer surface of an end wall assembly 12 and the other leg abutting the outer surface of the outermost end separator panel (with end portions of the vertical legs of members 18 and struts 26 or 26*a* deleted to accommodate the additional angle irons within collars 16) in order to provide additional support at the corners as shown in FIG. 22. It will also be understood that the structural member (32*a*) in divider assemblies 32 should be of sufficient structural strength to remain undeflected by the unequal pressures resulting from unequal rates of pouring concrete into the various form compartments, since the dividers are not reinforced by any means similar to collars 16. Nevertheless, pouring should be conducted as evenly as possible to minimize the chances for generating such unequal fluid pressures.

In addition, it will be understood that because of the relatively high viscosity of wet concrete, the "seal" formed around the various elements interior of form means 10 (e.g., between insulation and separator panels, between separator panels and divider assemblies, etc.) as a result of tightened collars 16 will be more than sufficient to prevent significant leakage of the concrete, especially if the parts are washed down after each use to remove any granular concrete particles. Furthermore, once the concrete is poured and top keys 40 are impressed, excess concrete can be screeded off by running any straight-edged member along the top edges of divider assemblies 32.

Although form means 10 has been discosed as including bottom 34, it will be understood that, if desired, it may be eliminated and bottom separator panels 36 adapted to extend under the end panels 30 and positioned directly within angle members 22 of frames 14*a*. In addition, the end separator assemblies and/or the bottom separator assemblies could be formed as integral units with groove-like members for holding the layers of insulation. However, for ease of assembling form means 10 as well as flexibility in configurations of layers in the hardened concrete panels, it is preferred to use distinct separator panels as described hereinbefore.

Advantageously, top buoyancy hold 24 is fastened down by threaded bolts 37 and appropriate fasteners (illustrated as channel members 38) to ensure the end separator panels do not become misplaced due to the buoyancy of the concrete. In addition, threaded bolts 36 also enable larger or smaller end separator panels to be utilized according to the width desired for the resultant panels. Although end separator panels 30 are completely visible in FIGS. 1 and 2, it will be understood that this was intended for illustration and they may be substantially covered by top buoyancy hold 24.

Thus, it will be appreciated that the present invention provides a relatively compact and convenient means for forming laminated, thermally insulated concrete panels. The panels can be formed on-site by simple gravity feed from a transit truck. Moreover, with relatively few distinct separator panel configurations, as more fully described hereinafter, various laminate structures can be formed. Moreover, panels can be formed with more than three laminates, unlike conventional "tilt-up" techniques whereby a three-layered panel is about all that can be practically made.

Referring briefly to FIGS. 5*a* through 9*a*, there are illustrated exemplary embodiments of end and bottom separator panel assemblies with corresponding resultant structural panels shown in FIGS. 5*b* through 9*b*, respectively. Accordingly, it will be understood that when concrete layers in the hardened panel are completely disconnected (i.e., completely separated by a layer of insulation) each pair of adjacent end separator panels 30 are spaced apart by spacing members 30*a*, for accommodating the sheets of insulation, without damaging it by "squeezing" too deeply. To this end, small portions of the insulation are cut out to accommodate spacing members 30*a*. However, of course, when concrete layers of the resultant panel are to be interconnected, such as in FIGS. 6*a–b* and 7*a–b*, spacing means 30*a* are not necessary since portions of the end panel members are adapted to abut each other.

As preferably embodied, when the resultant structural panel contains concrete layers which are essentially disconnected from each other (such as those illustrated in FIGS. 5*b*, 8*b* and 9*b*) each bottom separator panels corresponding to such disconnected concrete layers may include key structures 40 for forming a key in each such layer for erecting the panels (i.e., standing the panels up on end) and thereafter positioning them in place on the building under construction, as described more fully hereinafter.

Figure 6A:
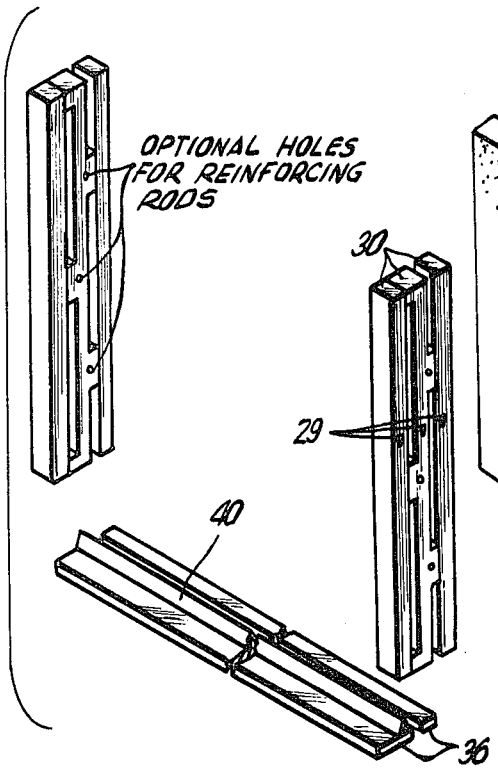
Figure 6B:
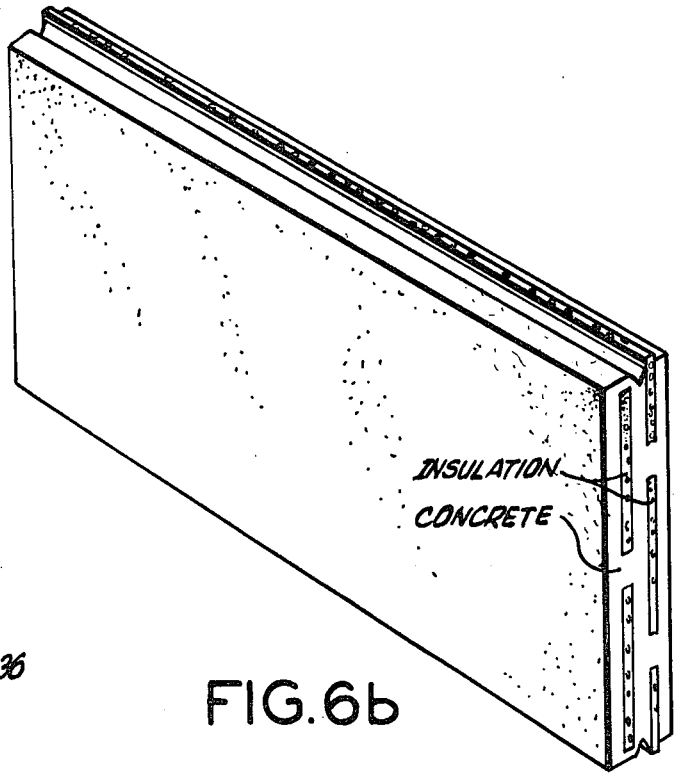
Figure 7A:
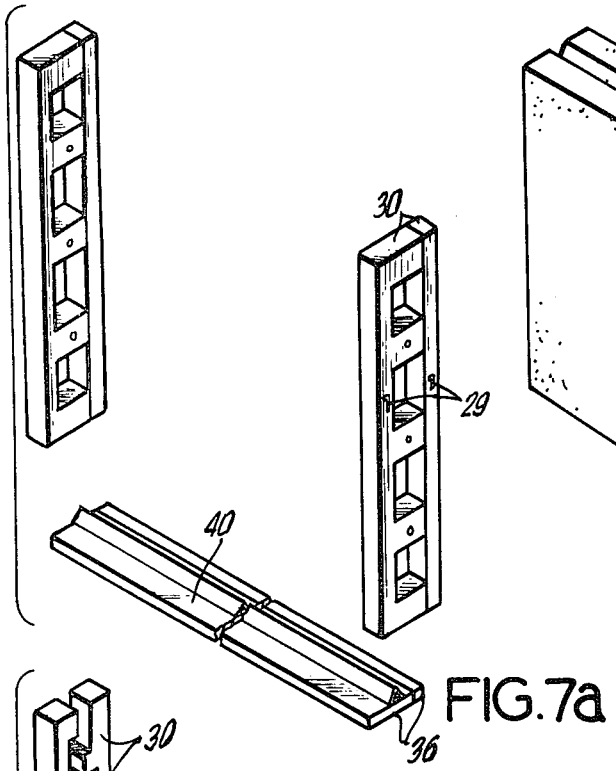
Figure 7B:
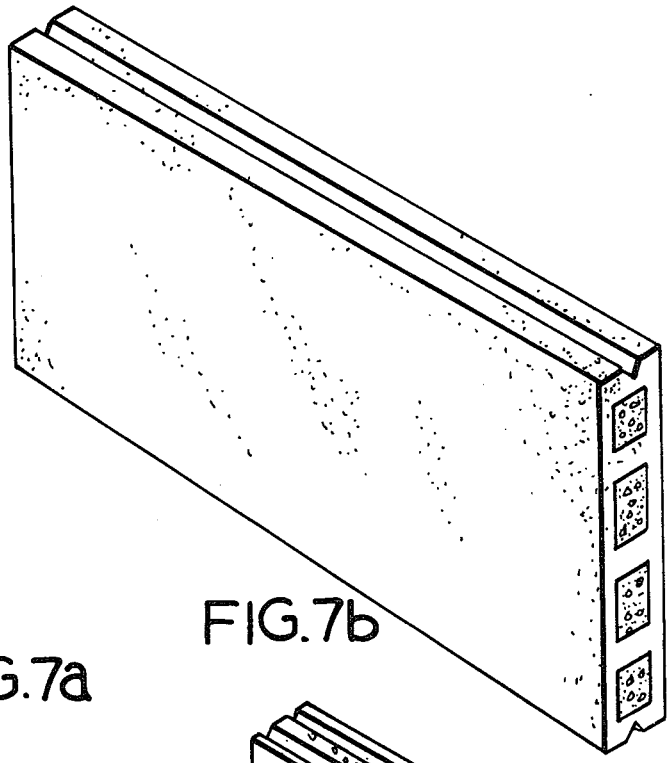

Referring generally to the various exemplary embodiments of resultant structural panels, the panels have interconnected concrete layers such as shown in FIG. 7*b* are provided with substantial strength against one concrete layers "shearing" with respect to another through the structurally weak layer of insulation. Unfortunately, because of the direct interconnection between concrete layers, a thermal path is provided for ameliorating the insulative effect of the thermal insulation segments. However, since, among its advantages, the present invention enables concrete panels to be formed from more than three layers, layers of thermal insulation can be staggered (such as shown in FIG. 6*b*) to substantially elongate the thermal path between directly connected layers of concrete and, therefore, substantially improve the over-all thermal characteristics of the structural panel by reducing the effect of "cold spots" detectable through the panel.

Figure 23A:
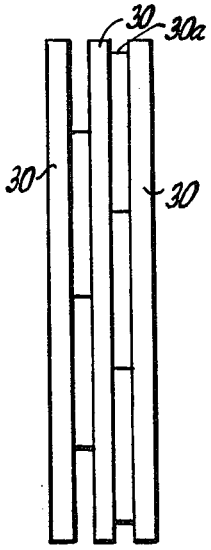
FIGS. 23*a*–*c* show various components for a preferred "shear connected" concrete panel fabricated according to the invention.
Figure 23C:
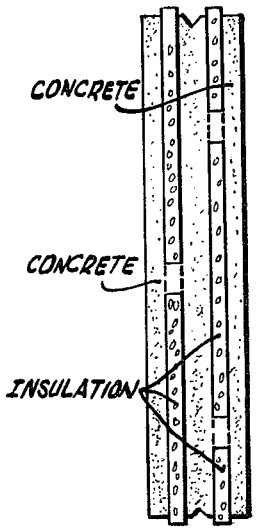
Figure 23B:
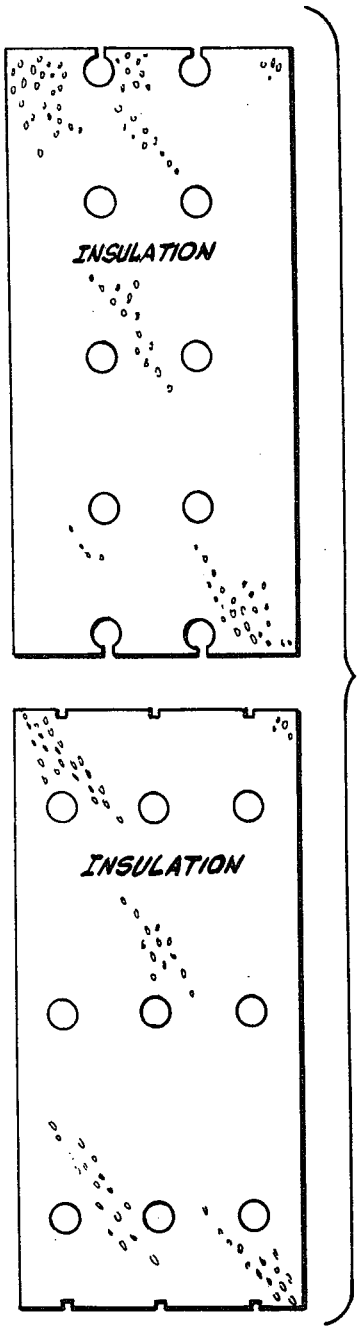

Alternatively, a five-layer panel can be formed by using an end separator assembly as shown in FIG. 23*a*, where in three layers of concrete will be separated by two layers of thermal insulation. Advantageously, as shown in FIG. 23*b*, the layers of insulation include a plurality of non-aligned holes of about 2 to 4 inches in diameter. In this way, the thermal path from the exterior concrete layer to the interior concrete layer can be even further elongated to provide an even more effective thermally insulated structural panel with sufficient interconnection among concrete layers to prevent "shearing" when the panel is raised to its final position on the structure being constructed. FIG. 23*c* shows a top view of the erected resultant panel.

Figure 5A:
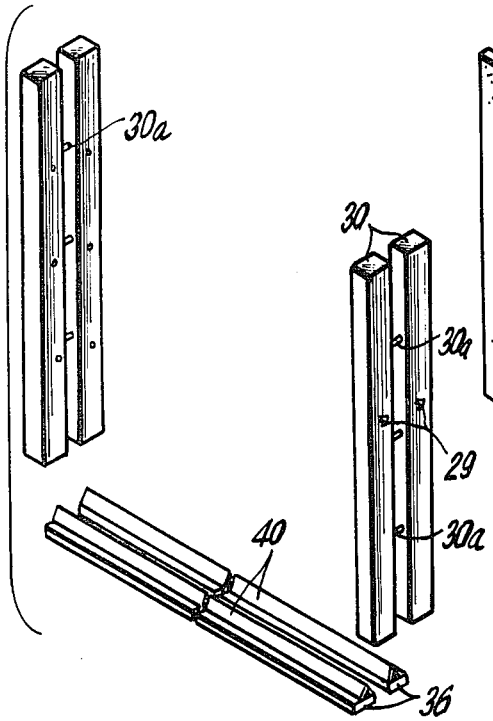
FIGS. 5*a*, 6*a*, 7*a*, 8*a* and 9*a* are truncated perspective views of exemplary end and bottom separator panels according to the present invention.
Figure 5B:
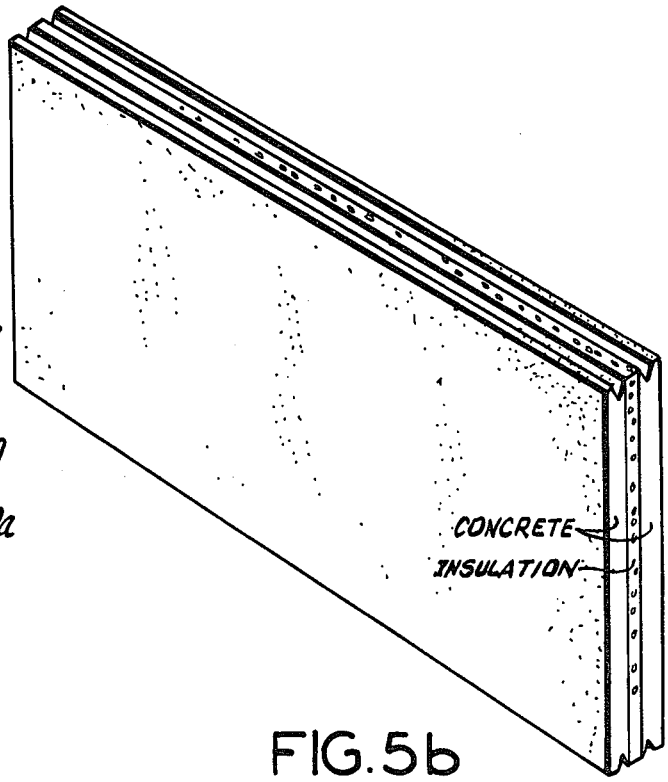
FIGS. 5*b*, 6*b*, 7*b*, 8*b* and 9*b* are truncated perspective views of resultant structural panels formed by the separator panel assemblies shown in, respectively, FIGS. 5*a*, 6*a*, 7*a*, 8*a* and 9*a*.
Figure 8A:
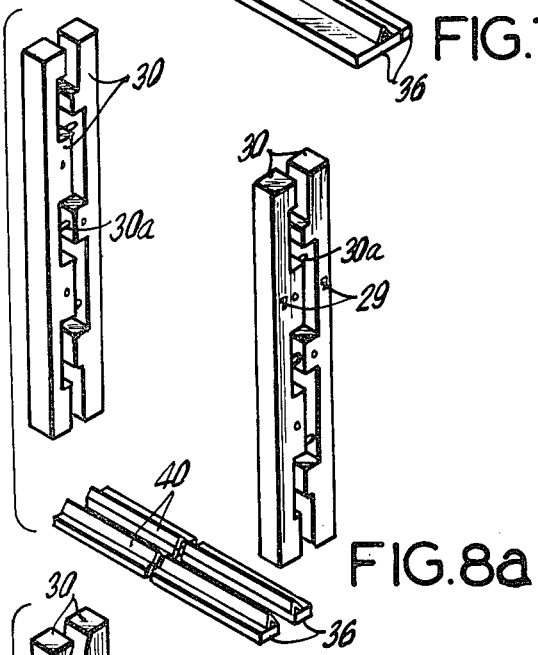
Figure 8B:
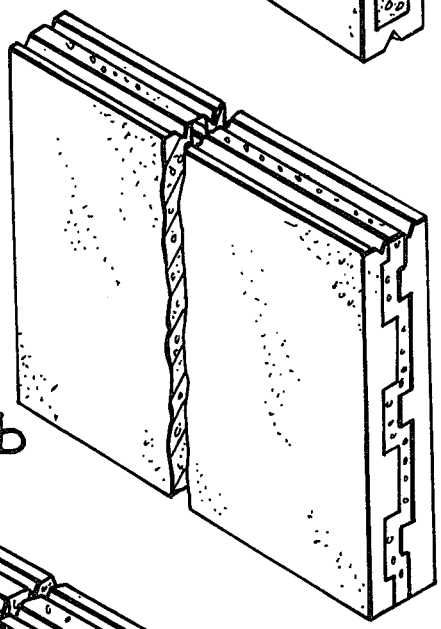
Figure 9A:
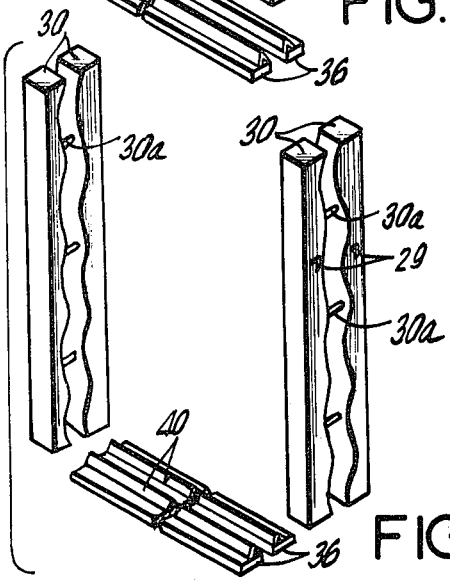
Figure 9B:
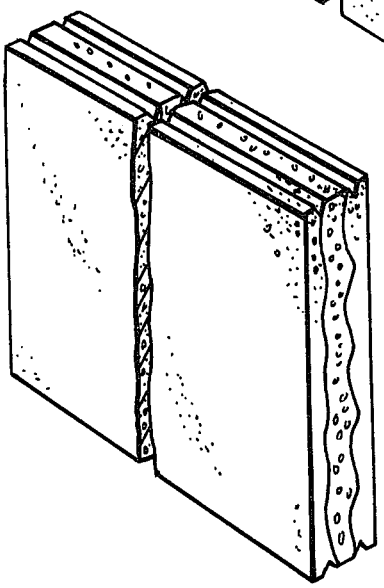

However, further advantageously, form means for fabricating pre-cast structural panels according to the present invention enables multi-layered structural panels to be formed, wherein the concrete layers are completely separated by the layer of insulation, as shown in FIGS. 5*b*, 8*b* and 9*b*, for essentially complete thermal insulation (subject only to the inherent thermal conductivity of the insulation material). Moreover, despite the absence of "shear" connections between the layers of concrete, the panels fabricated according to the present invention can be erected, lifted and installed in place substantially without causing one disconnected concrete layer to be "sheared" with respect to another. Furthermore, the concrete layers can be adapted for additional buckling strength such as by utilizing a panel of thermal insulation adapted to provide corrugated interior surfaces on the concrete layers (see, FIG. 9*b*) or a step-like thermal panel (as shown in FIG. 8*b*) to provide step-like projections on the interior surfaces of the thermal layers. It will be understood that, since the apparatus for forming concrete panels according to the present invention is adapted to form panels which will lie on-edge, such irregular internal surfaces can be formed in a single pouring operation unlike currently known techniques.

Figure 20:
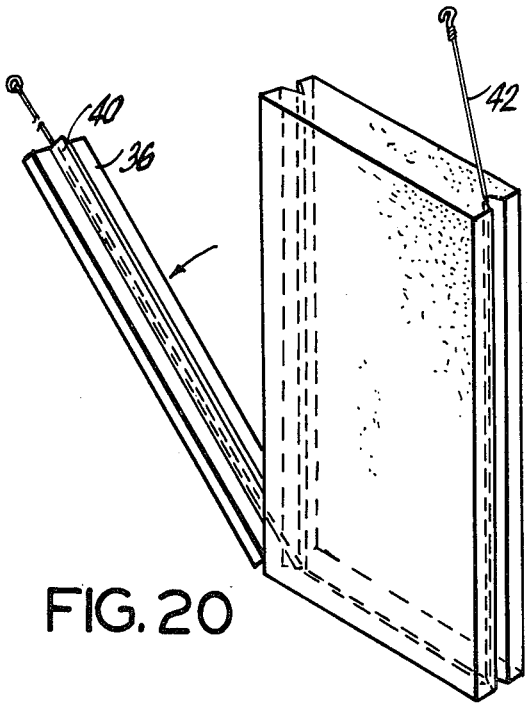

After the concrete in form means 10 has hardened, form means 10 may be disassembled by decoupling collar 16. To this end, bolts 28 on the adjustable side strut members 26 are first unthreaded to release pressure on its adjacent side wall 12*a*. Thereafter, the adjustable side strut members 26 may be disconnected from lateral members 18 so that at least one of the side wall assemblies may be removed as well as both end wall assemblies, leaving a "loaf" of concrete panels lying on edge on the bottom separator panels 36. A steel cable, indicated at 42, may then be threaded through each hollow key form 40 on the bottom separator panels corresponding to one hardened panel and brought completely around the panel. Thus, the panel can be erected (i.e., stood up on end) and then lifted from form means 10, with the bottom separator panel attached thereto, by a small crane or the like into position on the structure under construction. Once the panel is in place, cable 42 is let slack and the bottom separator (or just key 40) is removed as shown in FIG. 20.

Figure 13:
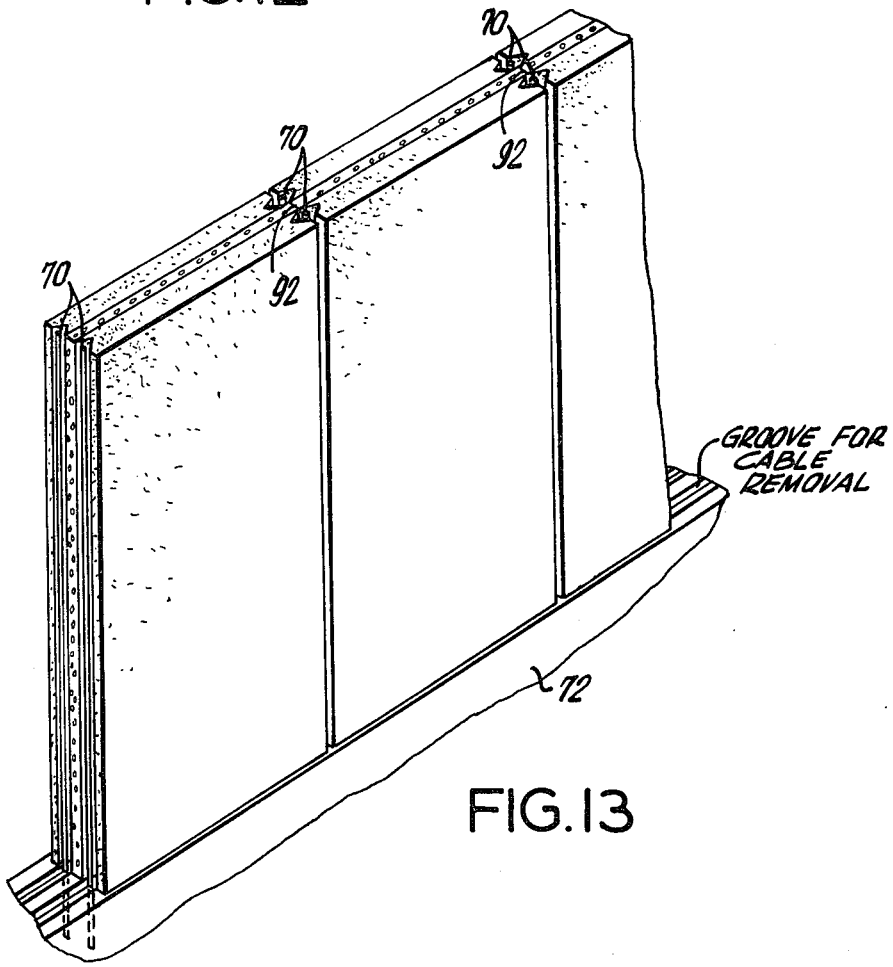
FIG. 13 is a perspective view of an exemplary arrangement of pre-cast structural panels in accordance with the present invention.
Figure 17:
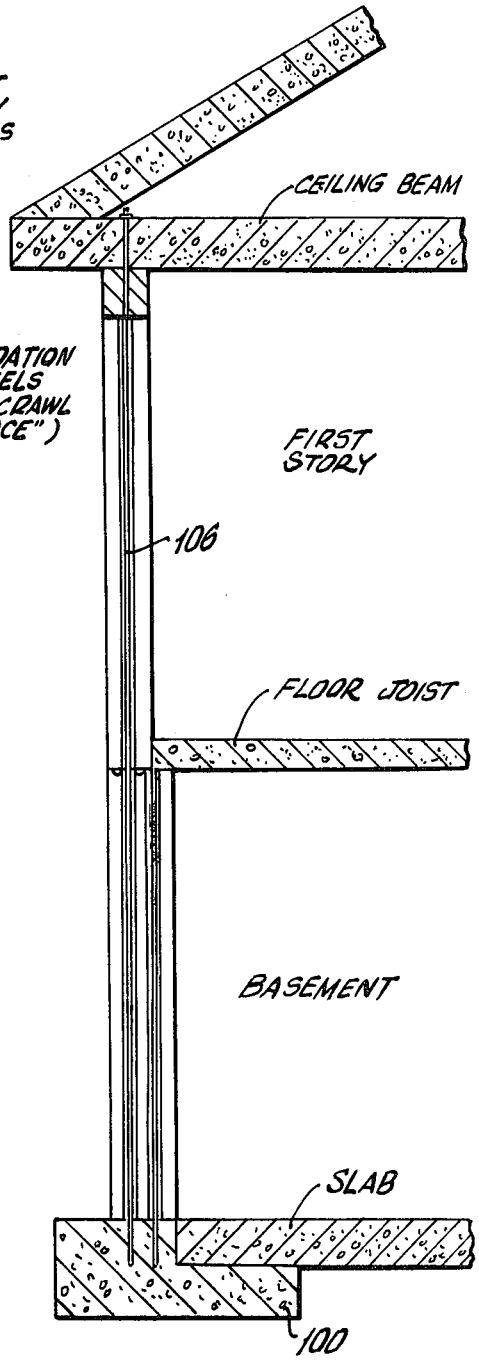
FIG. 17 is a sectional view of an exemplary two-story building structure utilizing pre-cast structural panels fabricated according to the present invention.

Alternatively, if, as described above, the key forms 40 are removably attached to the separator panels such as, for example, by wedging them into grooves formed in the bottom separator panels 36, they can be released when the hardened concrete panels are either erected or put in place on the building. Once the panel is in the desired location, the cable may be loosened and removed through a groove formed in the foundation or support member for the panel, as shown in FIGS. 13 and 17, which may also be used for mortaring the panels in place. Alternatively, a key form 40 may be attached to one end separator panel so that the cable-removing notch may be formed in the panel rather than in the foundation.

Where the panels are formed with interconnected concrete layers (or "shear" connections), the panels can be lifted with little or no concern for separating (or "shearing") the heavier concrete layers over the lighter insulative layers during the lifting. However, where the panels include a continuous thermal layer separating one or more concrete layers, each concrete layer is formed with key-ways (each bottom separator panel 36 having included a key 40) such that a cable may be wrapped around each concrete layer for simultaneous support when being erected and lifted. In addition, bracing means in the form of a vice-like gripping member may also be secured about the outermost layers of the panel at one or more positions after the panels have been erected to maintain the integrity of the panel during the lifting operation.

Figure 18:
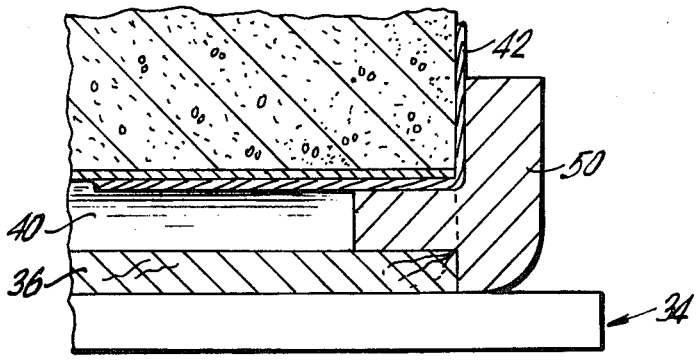
FIGS. 18–20 are various views showing various stages of erecting pre-cast structural panels fabricated according to the present invention.
Figure 19:
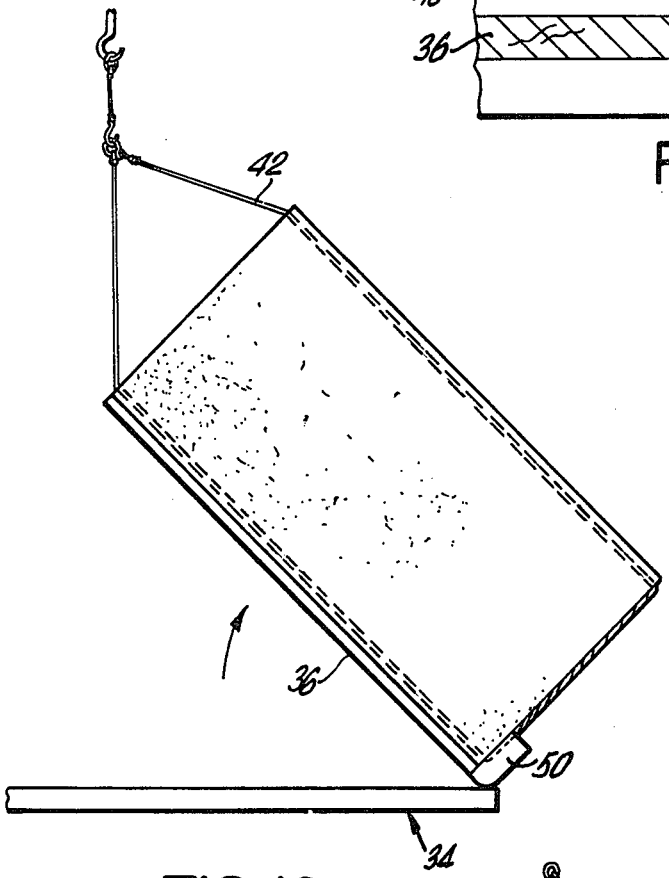

Also advantageously, corner brace 50, illustrated in FIGS. 18 and 19, may be used to protect the corner of the panel as it is initially tilted upright. Brace 50 may, for example, include leg 50*a* adapted for insertion within the hollow key form 40, with a suitable cut-out to accommodate cable 42 between it and the panel, and base portion 50*b* adapted to extend along a portion end of the hardened panel, also with a cut-out to accommodate cable 42. Thus, the panel may be tilted upright on cornerbrace 50 which is advantageously formed with a rounded corner to facilitate tilting. After the panel is tilted upright, or erected, it may be lifted completely off the ground and brace 50 may simply fall or may be easily removed. It will be understood that for panels having two or more keys, cornerbrace 50 may be provided with a corresponding number of legs 50*a* for insertion therein.

Figure 3:
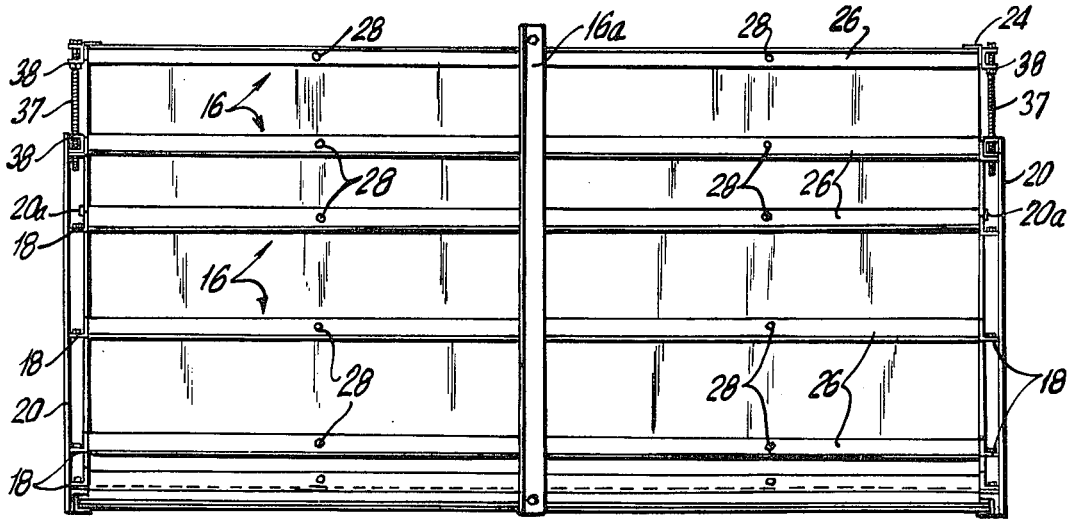
FIG. 3 is a side view of the embodiment of FIG. 1, showing optional additional reinforcing means.

It will also be understood that if a large number (e.g., about eight) of panels are desired to be made at one or if panels substantially longer than about 8 feet are to be made such as for industrial buildings, additional reinforcing member 16*a* may be positioned around the midpoint of collars 16, as shown in FIG. 3. In order to accommodate additional member 16*a*, bottom 34 may be formed with a discontinuity sufficiently large to allow an elongate bolt, for example, to pass under all of the bottom separator assemblies to be fastened between the vertical members of additional member 16*a* on both sides of form means 10. Thus, for example, two plywood sheets may be positioned side-by-side with a space therebetween to accommodate the elongate bolt.

Figure 10:
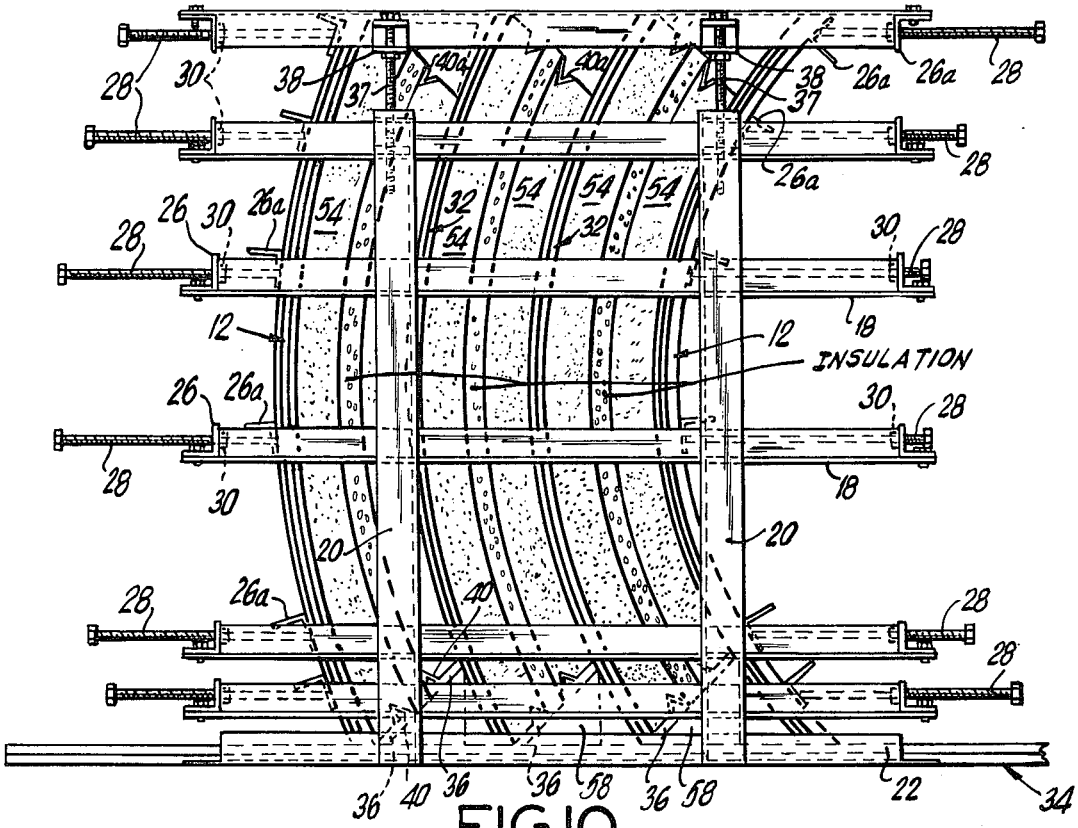
FIG. 10 is an end view of another preferred embodiment of the present invention for forming curved structural panels.
Figure 11A:
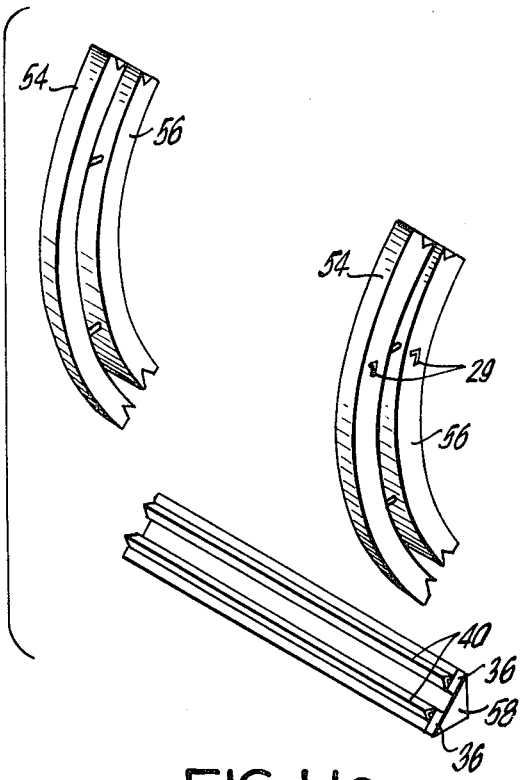
FIG. 11*a* is a perspective view of curved end separator panels and a bottom separator panel corresponding thereto for use in the embodiment shown in FIG. 10.
Figure 11B:
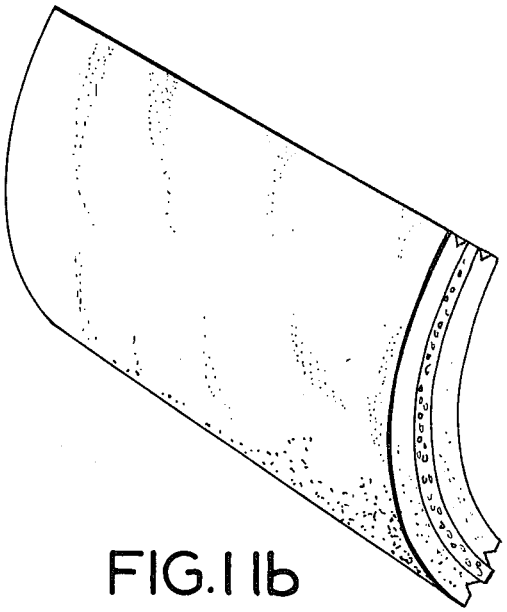
FIG. 11*b* is a perspective view of a resultant structural panel formed by the separator panel assembly shown in FIG. 11*a*.

Referring now to FIGS. 10, 11*a* and 11*b*, there is shown another aspect of the present invention, advantageously suited for conveniently forming curved precast structural panels at the construction site by substantially the same means (except as hereinafter described) as described hereinbefore. According to this aspect, end wall frames 14*a* are substantially as described above with respect to FIGS. 1, 4*a* and 4*b*. Moreover, collar 16 is substantially similar to that described above except that both side wall assemblies are provided with additional side struts 26 so that adjustable fastening means are provided on both sides of form means 10. Also according to this aspect, the end wall separator panels (here indicated at 54 and 56) may be formed substantially similar to end separator panels 30, as described more fully hereinbefore.

Although side walls 12*a* and divider assemblies 32 may be substantially as described above, it is preferred that they be somewhat more flexible in order to deform in accordance with curved separator panels 54–56. To this end, the support panel 32*a* of divider assemblies 32 and side wall 12*a* may be a generally strong but flexible and resilient material such as Masonite, a plastic substrate or thin sheets of plywood, while the non-stick plastic inserts 32*b* and 12*b* are also included in these assemblies substantially as described above. Alternatively, the structural members 32*a* and 12*a* in divider assemblies 32 and the side wall assemblies 12 may be pre-formed in the desired curved configuration.

Also advantageously, the bottom separator panels are substantially similar to bottom separators 36, including hollow key forms 40, as described more fully hereinbefore, but are preferably positioned on top of generally wedge-like members 58 which provide the desired edge angle for the resultant pre-cast structural panels. Thus, the layers of insulation for each form compartment will be held between adjacent end separator panels 54 and 56, conforming to the shape thereof, with their bottom edges held between the bottom separator panels, substantially as described above with respect to the "flat" panel formation.

Operation, or assembly, of form means 10 as shown in FIG. 10 is carried out substantially as described above. Thus, a pair of end separator panels 54 are releasably attached to oppositely disposed end frames 14*a* and abutting one side wall assembly 12, followed by a panel of insulation and then the second pair of end separator panels 56 (with stop means 55 therebetween to space completely disconnected concrete layers for accommodating the layer of insulation). Thereafter, bottom separator panels 36, placed on wedge 58 are positioned under their corresponding end separators 54 and 56 to support the bottom separators in their desired positions, followed by divider assembly 32 and another set of end and bottom separator panels, etc., until the second side wall assembly is installed.

After all the end and bottom separators and the divider assemblies have been placed between the two end wall assemblies 12, and the adjustable collar struts 26 have been attached to lateral elements 18, the bolts 28 on the collar member nearest the mid-section of form means 10 are tightened, the one on the left (looking at FIG. 10) first so it abuts the first end separator panel 54 and then the one on the right until the elements interior of the side wall assemblies 12 have been "squeezed" together. Thereafter, the remaining bolts are tightened.

Once collar 16 has been tightened around form means 10, the concrete may be poured into the several form compartments. At the end of the pouring operation, the top surface of the wet concrete in each compartment may be hand screeded to provide the desired angle for the edge of the resultant panel formed thereby after which top key forms 40*a* may be pressed into the top surfaces substantially as described hereinbefore. It will be understood that due to the high viscosity of typical concrete used in construction, the top surface will substantially retain the angular edge formed thereby. Alternatively, the angle of wedge 58 may be increased in order that the top surface of concrete in each compartment may simply be screeded generally flat, yet the resultant panel will have the desired angular configuration for both edges.

After the concrete is hardened, form means 10 may be disassembled, leaving a "loaf" of curved panels which may be erected and lifted into position. Accordingly, erection and lifting may be carried out substantially as described above except cornerbrace 50 will be dimensioned to accommodate wedges 58. In addition, due to the curvature of the panels, either all panels in the "loaf" may be stood up at once, or each one to be lifted may be moved away from the others just prior to erection so that there will be no damage during the erection, or standing-up, operation.

It will be understood that the general insulation configurations described above with respect to FIGS. 6*b*, 7*b* and 23 may be implemented in curved panels according to the invention. However, it is preferred that for any layer of concrete having a key-way formed on its edge, the layer should be about 3 inches thick for adequate strength at such edges to, for example, support cables 42 when wrapped around for lifting.

It will also be understood that separators 54 and 56 may be adapted for forming panels representing various angular arc portions of a circle, such as, for example, 90°, 60°, 30°, etc., and adjustable buoyancy hold 24 can accommodate the various heights of separators 54 and 56 required. In addition, if wedge 58 is not used, the resultant hardened panels can be positioned to form a serpentine configuration (shown in FIG. 14) or a corrugated facade (not shown).

Turning now to FIG. 13, there is shown a plurality of erected pre-cast panels fabricated in accordance with the present invention. Accordingly, at least one line of spaced reinforcing rods 70 may be firmly embedded in the foundation, or floor section (indicated at 72) on which the panels are to be set, and spaced in accordance with the width of the pre-cast wall panels is to be installed. Thus, when each wall panel is set in place, at least one reinforcing rod 70 generally resides within the enlarged keyway formed between two adjacent panels. Thereafter, when several panels are aligned, as shown in FIG. 13, the inter-panel spacing, including the keyways with rod(s) 70 therein, can be filled with mortar to bond the panels together, reinforcing rods 70 thereby serving to connect the panels to the foundation 72. Moreover, when suitably elongated, rods 70 can also act as sill bolts for connecting window sills (not shown) or they may be used to fasten the ceiling beam, as shown in FIG. 17.

In addition, where rigid insulation is retained within spacings defined by the end separator panels 30 as well as by bottom separator panels 36, a border of insulation can be made to protrude a little beyond the edges of the concrete layers in the finished pre-cast panels such that when the sides of the panels and/or the tops of the panels are placed adjacent another panel, the extra lengths of insulation between such panels can be in contact (as shown), for example, at 92 in FIG. 13) to provide an essentially continuous layer of insulation, even through the mortar joint.

It will be understood that the foundation upon which finished panels are placed may be prepared in the usual way and the hardened panels thereafter simply positioned on top of it. However, referring more particularly to FIG. 15, panels fabricated according to the present invention may be employed in the construction of the foundation itself. To this end, footings 100 may be prepared in the usual way, but instead of erecting forms on top of the footings, pouring concrete thereinto and stripping away the forms after the concrete is set, precast concrete panels made in accordance with the present invention may be secured to the top of footings 100 to form a foundation or a "crawl space" under, for example, a residential home built with concrete panels according to the invention.

Figure 15:
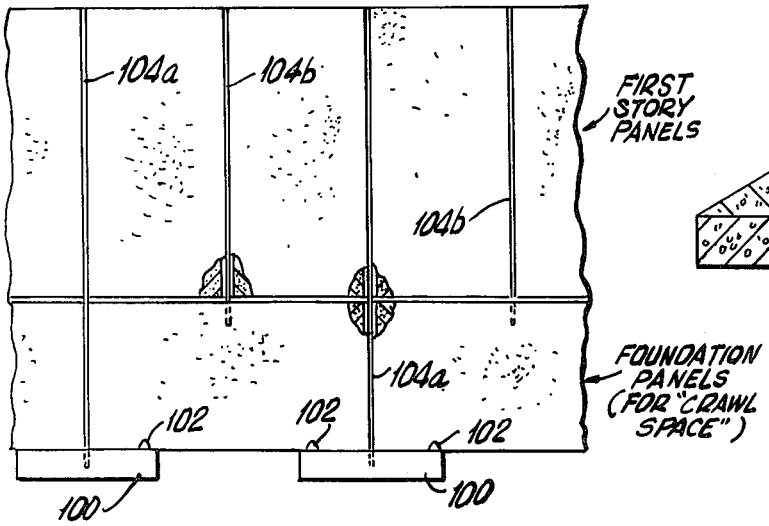
FIG. 15 is an elevation view of one embodiment of a foundation and exterior wall structure using precast panels fabricated according to the present invention.

The foundation level, or the "crawl space", may thus be formed by positioning the concrete panels on edge over the footings, with their long sides extending generally horizontally as shown in FIG. 15, so that the foundation or "crawl space" is as tall as the panel width. Thereafter, the first story level may be placed over, or secured to the top edges of the foundation level in any conventional manner. Thus, the first story exterior wall level may be constructed by erecting and lifting the concrete panels onto the foundation level, with their longest sides extending vertically as shown in FIG. 15. Of course, it is preferred to form first story level substantially as described with reference to FIG. 13 and as more fully described hereinafter.

If the footings are spaced apart so that each concrete panel is suspended between two footings, it will be preferred to form the concrete panel with internal steel reinforcing which may be simply accomplished by spanning reinforcing rods between end separator panels 30 in form box 10. Moreover, it is advisable to provide "shear" connections between concrete layers, as described more fully above, since the importance of high thermal insulation in the foundation or "crawl space" is not as great as for the exterior walls.

Figure 24:
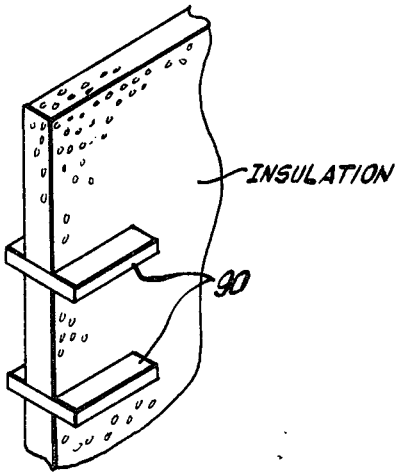
FIG. 24 is a perspective view of means for forming joist-accommodating slots according to the present invention.

In addition, although the foundation level panels could be erected and lifted over the footings (as described above with reference to FIGS. 18 and 19) and then re-tilted on its side, it will be preferred to form the bottom side of the panel with notches so that cables 42 can be wrapped under the panel to lift it and place it directly on footings 100, without the need for first erecting or standing the panel on end. To this end, key forms 40 are not needed on the bottom separator panels and inserts (not shown) may be attached to the bottom edges of the insulation layers in form box 10 prior to pouring to form two or more notches 102 in the bottom edge of the hardened panel, substantially analogous to the formation of joist-accommodating slots by inserts 90 as described herein with respect to FIG. 24. Thus, after the concrete is hardened and form means 10 is disassembled, the inserts can be removed so that cables 42 may be inserted therethrough and the panel lifted in place on footings 100 and cables 42 slid back through notches 102. However, it will be understood that other methods of lifting the panel may be used.

Advantageously, rods **104*a* are embedded in footings 100 and advantageously extend about 12 feet above the top surfaces thereof, in order that coupling may be provided between footings 100 and the foundation panels, as well as with the exterior wall panels. To this end, key-ways may be formed on the two ends of these panels by attaching key forms 40 to the end separator panels. In addition, additional reinforcing rods 104*b* may be formed directly in the top edge of the foundation panels and spaced so that each first story panel is placed between reinforcing rods, generally as described herein with respect to FIG. 13. To this end, a rod 104*b* may simply be inserted into the top of each form compartment while the concrete is hardening (held in place by any suitable support means) so that the resultant concrete panel is formed with rod 104*b* extending out of its top edge. Thereafter, the first story panels may be joined together by filling the inter-panel spaces, having rods 104*a* and 104*b*** retained therebetween, with mortar.

Figure 16:
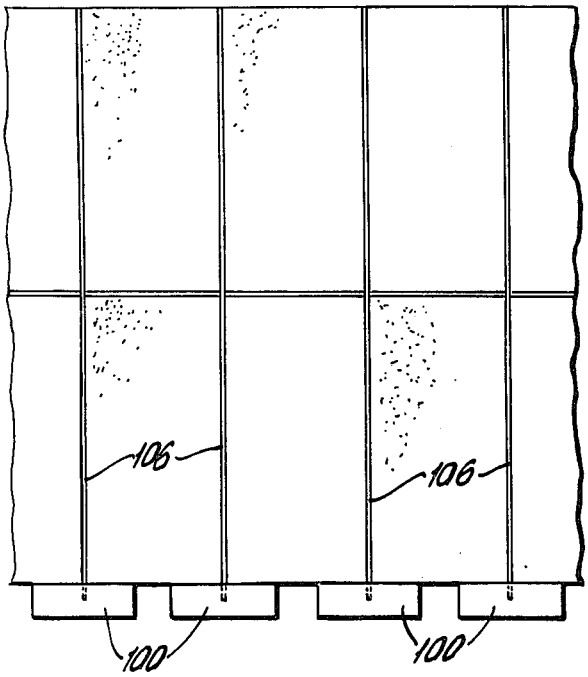
FIG. 16 is an elevation view of the exterior wall of a multi-story building structure using precast panels fabricated according to the present invention.

According to another aspect of the present invention, the foundation level may be formed by placing the concrete panels on footings 100, with their long sides extending vertically as shown in FIGS. 16 and 17. Thus, the eight foot foundation provided, which thereby may be used to form a full basement if a suitable floor slab is also provided, as shown in FIG. 17. In this context, a basement can be provided, which has high thermally insulative capabilities as well as provides a moisture barrier. Moreover, as set forth more fully above, the wall surface may be conveniently furnished with a desired texture or design by the use of appropriate inserts **12*b* and 32*b* in form means 10. Advantageously, the footings 100 of FIGS. 16 and 17 are also formed with reinforcing rods 106, similar to rods 104*a* described above with respect to FIG. 15**, except they may be 16 feet or more in length.

Referring now more particularly to FIG. 17, the building may be constructed by utilizing pre-cast panels of differing thicknesses to accommodate floor joists. Accordingly, the foundation level wall panels, formed substantially as described above with respect to FIG. 16, may be of enlarged thickness for supporting the floor joist, as shown, since the first story wall panels need not be as thick because they do not support as great a compressive loading as the foundation panels. Because of the flexibility afforded by the interchangeable separator assemblies according to the present invention such panel construction can be easily carried out by the present invention.

Figure 25:
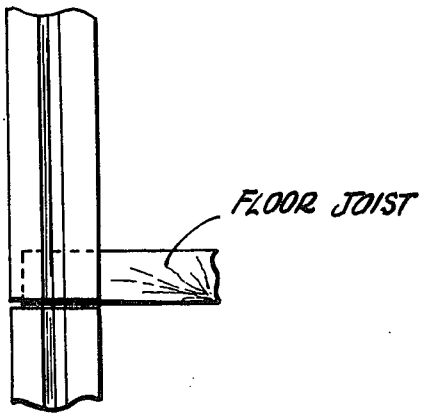
FIG. 25 is a side view of a panel made in accordance with the aspect shown in FIG. 24.

Alternatively, the first story panels can be adapted to receive end portions of the floor joists. To this end and referring to FIG. 24, there are shown means for forming precast structural panels according to the present invention, adapted to accommodate floor joists. According to this aspect, inserts 90 may be positioned in suitably dimensioned cut-outs formed in the panel of insulation, at desired offset distances, typically 16 inches apart. Thus, inserts 90 may be formed to the same width and thickness as the floor joist, typically 2 × 8 inches so that the resultant concrete panel has slots adapted to accommodate the floor joists, as shown in FIG. 25, yet provide a solid concrete surface on the other side of the panel. Advantageously, inserts 90 may simply be cut from pieces of excess insulation for cost savings and may simply be "dug" out of the hard concrete.

Also illustrated in FIG. 17, are means for securing a ceiling or roof sill, which are alternate to embedding sill bolts in the panel. According to this feature, reinforcing rods 106 can be adapted to extend beyond the top of the wall panel and through the roof sill (or any other structural beam such as a ceiling beam) such that the sill can be secured to the top edge of the wall panel by any suitable fastener.

Figure 14:
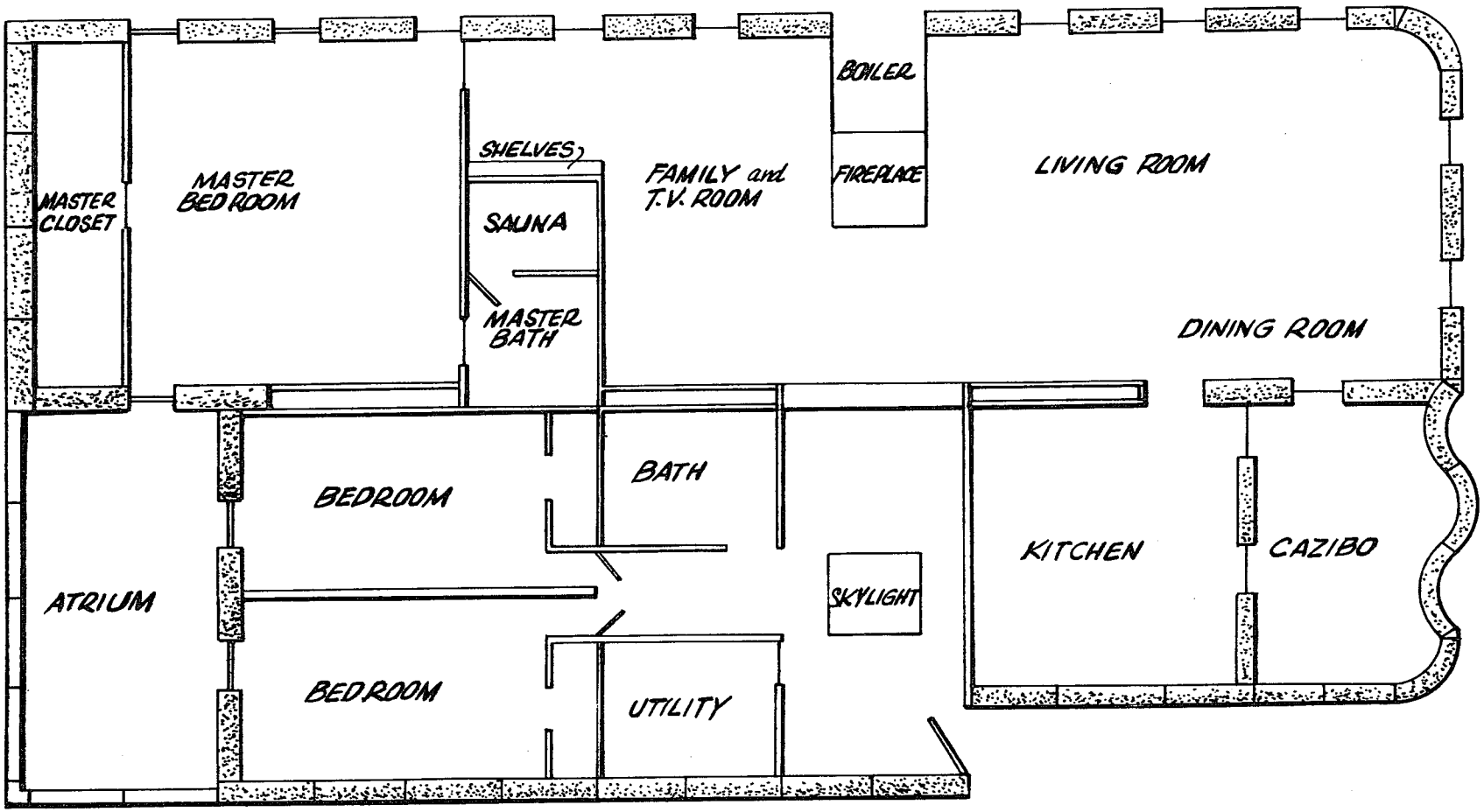
FIG. 14 is an exemplary floor plan for a building using pre-cast structural panels fabricated according to the present invention.

Accordingly, as illustrated by FIG. 14, all the exterior walls of a permanent building structure can be simply, and inexpensively constructed, with all form molding conducted on-site. Moreover, where indoor-/outdoor rooms are provided, such as a partially enclosed porch, patio or gazebo, all the walls surrounding such rooms can be inexpensively made of panels formed by the form means according to the present invention to provide reliable thermal insulation for the further interior rooms in the building.

It will be understood by those skilled in the art that the invention in its broader aspects is not limited to the specific embodiments herein shown and described, but variations therefrom may be made without departing from the scope and spirit of the invention, as defined in the accompanying claims, and without sacrificing its principal advantages. Thus, for example, when identically dimensioned panels are to be repeatedly formed, the end separators (as well as the bottom separator) may be formed in integral sets, or the end wall assemblies (as well as the bottom assembly) may be formed as a single unit with grooves formed therein to support the insulation and divider assemblies. However, for reasons of versatility, convenience as well as the other advantages described herein, the distinct end (and bottom) separator panels are preferred.

I claim:

1. Form means for forming pre-cast structural panels, which, when assembled, comprises:

a form box having a pair of generally opposed side wall assemblies and a pair of generally opposed end wall assemblies defining a generally hollow space interior thereof, each said end wall assembly comprising:

an end wall frame adapted to provide structural rigidity for said end wall assembly, and a plurality of end separator panels, each end separator panel adapted to be releasably attached to said end wall frame for forming said end wall assembly, adjacent end separator panels on said end wall frame being adapted to retainingly support structures positioned therebetween;

a bottom assembly generally abutting bottom portions of said end and side wall assemblies;

divider means positioned within said form box to define a desired number of form compartments in said form box, said divider means being supported in desired position between adjacent end separator panels; and releasably coupled collar means surrounding said form box generally against the exterior surfaces of said end and side wall assemblies for supporting said wall assemblies, such that said form box is retained in assembled configuration by said collar means, with said collar means urging said end separator panels towards each other to retain said divider means in desired configuration.

2. Form means according to claim 1 wherein said end separator panels are further adapted to retain intermediate panels made of a desired material in desired locations within said form box for forming multi-layer precast structural panels having a predetermined configuration of said intermediate panels embedded therein.

3. Form means according to claim 2 wherein portions of said collar means are formed as part of said end wall frames.

4. Form means according to claim 2 wherein said intermediate panels are panels of thermal insulation.

5. Form means according to claim 4, wherein said end separator panels are formed with spacer means on edges adapted to support said intermediate panels, said spacer means adapted to separate adjacent end separator panels a distance equal to about the thickness of said intermediate panels to prevent adjacent end separator panels from damaging the portions of said intermediate panels retained therebetween.

6. Form means according to claim 1, wherein said collar means is adjustable to enable the width of said form box to be adjusted for forming different thickness pre-cast panels.

7. Form means according to claim 2 wherein said bottom assembly comprises:

a bottom support panel retained by said opposed end wall frames; and a plurality of bottom separator panels corresponding generally to said end separator panels; and wherein each of said end wall frames includes an adjustable top buoyancy hold for preventing the divider assemblies and insulation layers from rising due to the buoyancy of the mixture.

8. Form means according to claim 7 wherein each said side wall assembly includes a generally rigid exterior side wall member and a side wall insert panel positioned adjacent the interior surface of said side wall member, said side wall insert panel adapted to resist adherence of hardened mixture constituents thereto, said side wall assemblies positioned to bear against the outermost end and bottom separator panels for urging adjacent end and bottom separator panels against one another.

9. Form means according to claim 2 wherein said end wall assemblies are adapted to provide hardened structural panels having generally more than three layers.

10. Form means according to claim 1 wherein said releasably coupled collar means includes a plurality of collar assemblies, each comprising:

a pair of first generally elongate support struts, each extending at least essentially along the entire length of one of said side wall assemblies; and a pair of second generally elongate support struts, each of said second support struts extending at least essentially along the entire length of one of said end wall assemblies, each end of each of said second support struts being releasably coupled to an end of one of said first support struts, such that when completely coupled together, said support struts surround said form box, being in contact with the exterior surfaces of said wall assemblies, to support said form box.

11. Form means according to claim 10 wherein each of said support struts comprises an essentially L-shaped angle beam oriented with corresponding first leg portions adapted to make generally surface contact with the exterior surfaces of said wall assemblies and a second leg extending essentially perpendicular to said exterior surface.

12. Form means according to claim 11 which further include four pin members for each collar assembly and wherein each of said struts is formed with an extension on both ends of its said second leg members, each of said extensions having an aperture formed therein, such that when said struts are positioned with corresponding extensions over-lapping with said apertures in alignment, one of said pin members may be inserted into said aligned apertures to couple said support struts together around said form box.

13. Form means according to claim 12 wherein said collar assemblies are adapted to be positioned around said form box such that they are closer together generally near the bottom of said form box than near the top thereof to provide additional support at the bottom for the greater fluid pressure generated at the bottom.

14. Form means according to claim 12 wherein said second strut member are formed integrally as part of said end wall frames.

15. Form means according to claim 12 wherein all the first strut members adjacent at least one side wall assembly are adapted for adjustable support on said at least one side wall assembly.

16. Form means according to claim 15 which further includes an additional first support strut for each of said first strut members adjacent said at least one side wall assembly, said additional strut members adapted to be positioned adjacent said at least one side wall assembly, and a plurality of extensible bearing members adapted to extend between corresponding first struts and additional first struts to transmit the reinforcing support provided by said corresponding first strut members to said side wall assembly which may be positioned and supported at various locations relative to said first struts, such that the distance between said opposed side wall assemblies may be varied yet the side wall assemblies are supported for withstanding the internal fluid pressure.

17. Form means according to claim 16 wherein said additional first struts and said extensible bearing members are included along both of said opposed side wall assemblies.

18. Form means according to claim 1 wherein said bottom assembly comprises a generally flat bottom support panel retained between said opposed end frames and at least one bottom separator panel for each form compartment, each said bottom separator panel adapted to correspond to one of said sets of end separator panels; and wherein each of said end wall frames includes an adjustable top buoyancy hold for preventing said end separator panels from rising due to the buoyancy of the mixture.

19. Form means according to claim 18 wherein said end separator panels are formed in a generally curved configuration and wherein said divider means are adapted to conform to the shape of said curved end separator panels for providing structural panels with generally correspondingly curved surfaces.

20. Form means according to claim 19 wherein said bottom separator panels are generally wedge-shaped to provide a surface adjacent the mixture for forming an edge at any desired angle and which further includes a top separator panel for each form compartment, said top separator adapted to be retained under said top buoyancy hold for providing another edge at a desired angle at the top of said form means.

21. Form means according to claim 2 wherein said divider means comprise at least one divider assembly, each said divider assembly including:

a generally rigid intermediate panel adapted to rigidly define said form compartments despite uneven distribution of said hard-setting mixture; and a pair of divider inserts surrounding said intermediate panel and adapted to resist adherence of hardened panel constituents on said divider assembly.

22. Form means according to claim 21 which includes at least three of said divider assemblies, defining at least four of said form compartments.

23. Form means according to claim 2 wherein each said side wall assembly includes a generally rigid exterior side wall member and a side wall insert panel positioned adjacent the interior surface of said sidewall member, said side wall insert panel adapted to resist adherence of hardened form constituents to said side wall, said side wall assemblies positioned to bear against the outermost end separator panels for urging said end separator panels against each other.

24. Form means according to claim 1 which further includes corner brace means at each corner of said form box for ensuring that said corners are sealed and preventing damage thereto.

25. Form means according to claim 24 wherein said corner brace means comprise generally L-shaped beams extending from a point near said bottom to a point near said top, said L-shaped corner beam being retained within said collar means for bracing said corners, yet being removable therefrom when said collar means are removed to facilitate disassembly of said form means.

26. Form means according to claim 4 wherein said end separator panels are adapted generally to provide more than three layers in the resultant structural panel.

27. Form means according to claim 26 wherein said end separator panels are adapted to provide structural panels having shear connections between adjacent concrete layers.

28. Form means according to claim 26 wherein said end separator panels are adapted to provide structural panels having essentially disconnected layers of concrete.

29. Form means according to claim 26 wherein said end separator panels are adapted to provide structural panels having curved surfaces.

30. Form means according to claim 26 wherein said end separator panels are adapted to provide a corrugated surface on at least one layer of concrete.

* * * * *